US006116720A

United States Patent [19]

Inui et al.

[11] Patent Number: 6,116,720

[45] **Date of Patent: *Sep. 12, 2000**

[54] INK JET RECORDING METHOD AND APPARATUS FOR PREVENTING COLOR BOUNDARY BLUR

[75] Inventors: Toshiharu Inui; Naoji Otsuka, both of Yokohama; Jiro Moriyama; Nobuyuki Kuwabara, both of Kawasaki; Isao Ebisawa, Yokohama; Atsushi Arai; Hisao Yaegashi, both of Kawasaki; Kentaro Yano, Yokohama; Kiichiro Takahashi, Kawasaki; Osamu Iwasaki, Tokyo; Daigoro Kanematsu, Yokohama, all of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/891,723

[22] Filed: Jul. 14, 1997

Related U.S. Application Data

[63] Continuation of application No. 08/328,917, Oct. 25, 1994, abandoned.

[30] Foreign Application Priority Data

Oct. 28, 1993 [JP] Japan ..... 5-270583
Oct. 28, 1993 [JP] Japan ..... 5-270591

[51] Int. Cl.[7] ..... B41J 2/21; B41J 2/145; B41J 2/15; B41J 29/38

[52] U.S. Cl. ..... 347/43; 347/40; 347/14

[58] Field of Search ..... 348/43, 15, 40, 348/14; 395/109

[56] References Cited

U.S. PATENT DOCUMENTS 4,313,124 1/1982 Hara .
4,345,262 8/1982 Shirato et al. .
4,459,600 7/1984 Sato et al. .
4,463,359 7/1984 Ayata et al. .
4,558,333 12/1985 Sugitani et al. .
4,608,577 8/1986 Hori .
4,723,129 2/1988 Endo et al. .
4,740,796 4/1988 Endo et al. .
5,371,531 12/1994 Rezanka et al. ..... 347/43
5,428,377 6/1995 Stoffel et al. ..... 347/15
5,430,469 7/1995 Shioya et al. ..... 347/15
5,475,800 12/1995 Vaughn et al. ..... 395/109

FOREIGN PATENT DOCUMENTS 54-056847 5/1979 Japan .
59-123670 7/1984 Japan .
59-138461 8/1984 Japan .
60-071260 4/1985 Japan .

*Primary Examiner*—N. Le
*Assistant Examiner*—Thinh Nguyen
*Attorney, Agent, or Firm*—Fitzpatrick, Cella, Harper & Scinto

[57] ABSTRACT

A head for discharging yellow ink, magenta ink, cyan ink and first black ink having a relatively fast penetration velocity to a recording medium and a head for discharging second black ink having a relatively low penetration velocity are used to print an image. When a black image is adjacent to a color image, the black image is formed by using the first black ink, and when the black image is not adjacent to the color image, the black image is formed by using the second black ink. A black ink and a plurality of color inks having a different penetration velocity to a recording medium than that of the black ink are also used to print an image. Whether a color image area is present in the vicinity of a black image area of record data or not is determined, and whether the black image area is to be formed by the black ink or by the color inks is decided in accordance with the determination result, and when the black image is to be formed by the color inks, the color inks are used based on a mask pattern pseudo-randomly prepared to make the change in tonality less recognizable.

48 Claims, 20 Drawing Sheets

K
B
C
M
Y
Bk
102a
102b

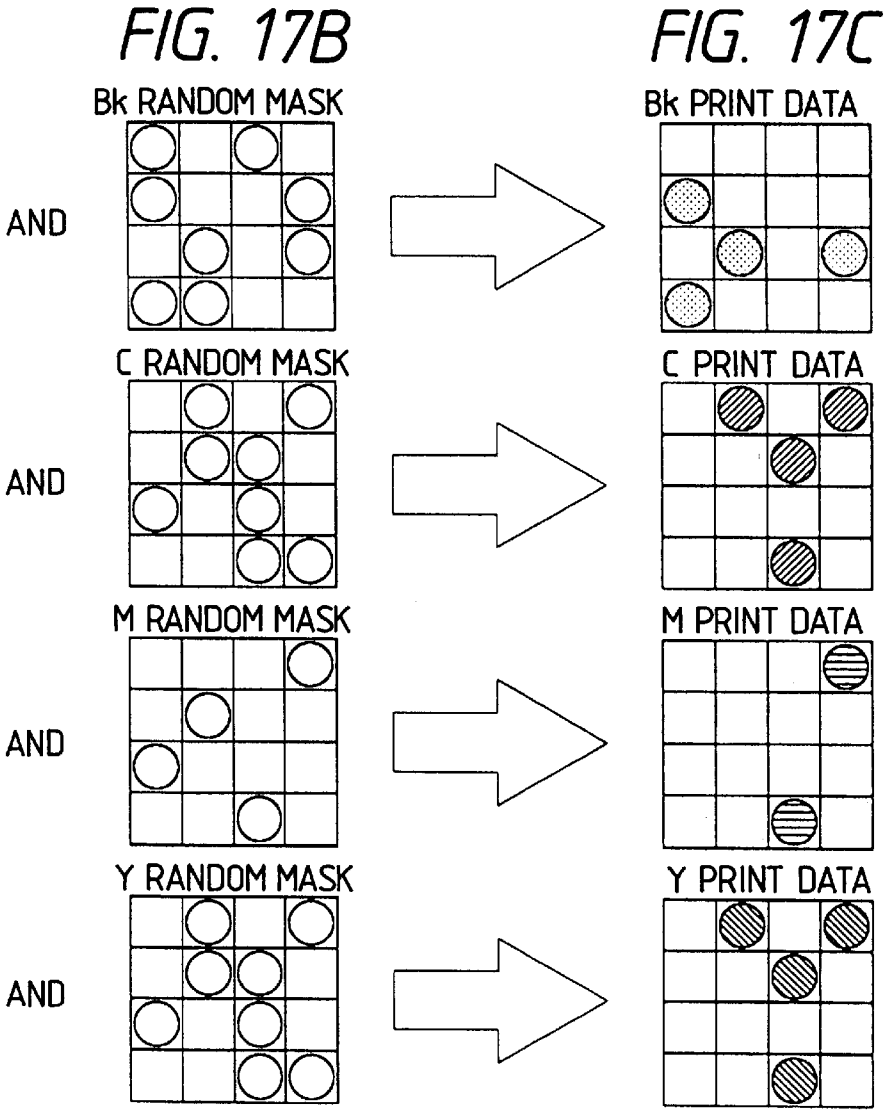
FIG. 17B
Bk RANDOM MASK
C RANDOM MASK
M RANDOM MASK
Y RANDOM MASK
AND
AND
AND
AND
FIG. 17C
Bk PRINT DATA
C PRINT DATA
M PRINT DATA
Y PRINT DATA
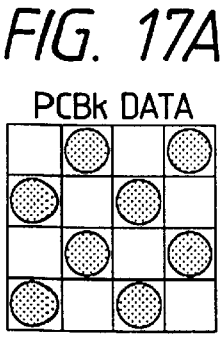
FIG. 17A
PCBk DATA

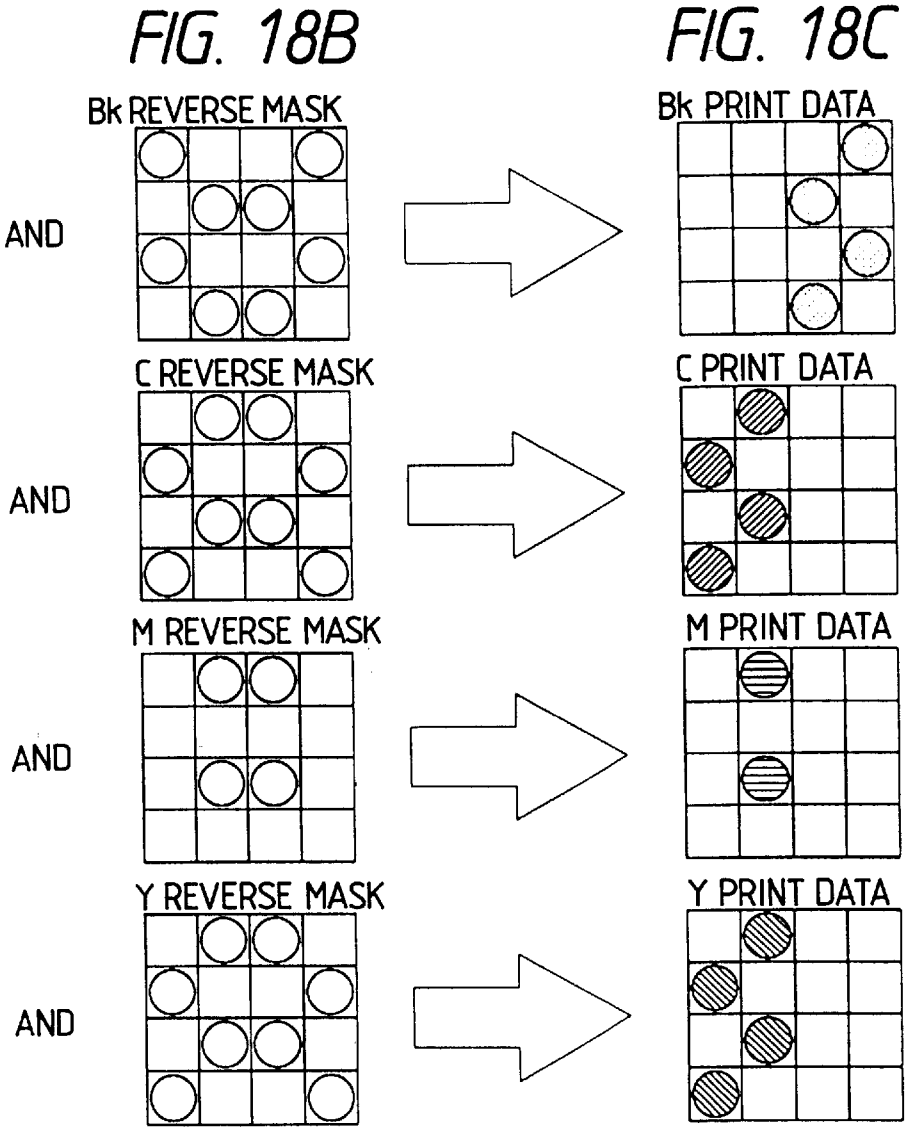
FIG. 18B
Bk REVERSE MASK
C REVERSE MASK
M REVERSE MASK
Y REVERSE MASK
AND
AND
AND
AND
FIG. 18C
Bk PRINT DATA
C PRINT DATA
M PRINT DATA
Y PRINT DATA
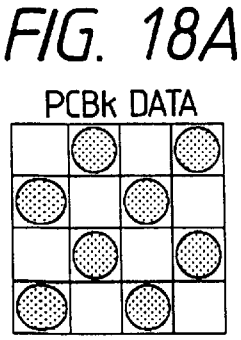
FIG. 18A
PCBk DATA Bk PRINT DATA
C PRINT DATA
M PRINT DATA
Y PRINT DATA Bk MASK
C MASK
M MASK
Y MASK
AND
AND
AND
AND PCBk DATA

INK JET RECORDING METHOD AND APPARATUS FOR PREVENTING COLOR BOUNDARY BLUR

This application is a continuation of application Ser. No. 08/328,917, filed Oct. 25, 1994, now abandoned.

BACKGROUND OF THE INVENTION

1. Field of the Invention

The present invention relates to a color ink jet recording method which permits sharp and high density recording of a color image, and more particularly to a color ink jet recording method using color inks such as yellow, magenta and cyan as well as black ink.

The present invention is applicable to any apparatus which uses a recording medium such as paper, cloth, non-woven material or even an OHP sheet, and particular applicable apparatuses include office equipment such as a printer, a copying machine and a facsimile machine, and mass-produced equipment.

2. Related Background Art

The ink jet recording method has been used in the printer, copying machine and facsimile machine because of its easiness for compaction in size, and colorization.

When the ink jet recording is applied to a color recording apparatus, it is necessary to use a special sheet having an absorption layer to attain a high tonality color image free from ink blur. Recently, as the ink is improved, an apparatus which permits the printing on a plain paper has been put into practice. However, the print quality to the plain paper is still in an insufficient level. One of the greatest factors therefor is the compatibility of the ink blur between different colors and the black record quality (especially the black character record quality).

When a color image is to be printed on a plain paper by the ink jet recording method, an instant dry ink which has a fast penetration velocity to the plain paper is usually used. As a result, a high quality image without the ink blur between different colors is attained in a color image area but the density in a black image area is low and so-called feathering in which the ink blurs along fibers of the paper occurs in the black image area.

For example, where a black image is present on a background color image area, the above problems in the black image area is relatively not prominent and the quality is not significantly degraded, but where the black image area is present independently from the color image area, the quality is degraded. Further, where the black image includes characters, the characters lack sharpness and are not clear and the quality is extremely poor.

In order to attain the high quality image having a high density in the black image area and no feathering, it is necessary to implant relatively low penetration velocity ink to the plain paper in a certain amount. In this case, however, the ink blur of the black ink and the color ink occurs at the boundary of the black image area and the color image area and the quality is significantly degraded.

The problem relating to the ink blur may be solved to a certain extent by a so-called fine mode in which an image is formed in a plurality of runs of main scan but the problems of the black image quality is not essentially solved.

SUMMARY OF THE INVENTION

It is an object of the present invention to provide an ink jet recording method and apparatus which attain a high print quality with a high density in a black image area and without the feathering where the black image area is present independently from a color image area.

It is another object of the present invention to provide an ink jet recording method and apparatus which attain a sharp image without the ink blur at a boundary of the color image area and the black image area.

It is still another object of the present invention to provide an ink jet recording method and apparatus which suppress the blur without changing the tonality when the black image area which contacts color image area is recorded.

It is still another object of the present invention to provide an ink jet recording method and apparatus which attain the high recording quality without the ink blur between the black ink and the color inks as well as the compatibility of the high quality black recording and the high quality color recording.

In order to achieve the above objects, the present invention provides a color ink jet recording method for recording by using yellow ink, magenta ink, cyan ink and first black ink having a relatively fast penetration velocity to a recording medium and second black ink having a relatively slow penetration velocity to the recording medium, comprising the steps of: determining whether a black image is adjacent to a color image or not; deciding whether the black image is to be formed by the first black ink or the second black ink in accordance with the determination in the step; and forming the black image in accordance with the decision.

The present invention further provides a color ink jet recording apparatus for recording by using yellow ink, magenta ink, cyan ink and first black ink having a relatively fast penetration velocity to a recording medium and second black ink having a relatively slow penetration velocity to the recording medium, comprising: means for determining whether a black image is adjacent to a color image or not and; means for deciding whether the black image is to be formed by the first black ink or the second black ink in accordance with the determination in one determination step.

The present invention further provides a color ink jet recording method for recording a color image on a recording medium in accordance with record data by using black ink and a plurality of color inks having a different penetration velocity to the recording medium than that of the black ink, comprising the steps of: determining whether a color image is present in the vicinity of a black image area of the record data or not; deciding whether the black image is to be formed by the black ink or the color inks in accordance with the determination in one determination step; and when the black image area is to be formed by the color inks, forming the black image by using a mask pattern prepared pseudo-randomly.

The present invention further provides a color ink jet recording method for recording a color image on a recording medium in accordance with record data by using black ink and a plurality of color inks having a different penetration velocity to the recording medium than that of the black ink, comprising the steps of: determining whether a color image is present in the vicinity of a black image area of the record data or not; deciding whether the black image is to be formed by the black ink or the color inks in accordance with the determination in one determining step; and when the black image area is to be formed by the color inks, forming the black image by using a mask pattern based on an alternate arrangement of a basic pattern and an inverted pattern of the basic pattern.

The present invention further provides a color ink jet recording method for recording a color image on a recording medium in accordance with record data by using black ink and a plurality of color inks having a different penetration velocity to the recording medium than that of the black ink, comprising the steps of: determining whether a color image is present in the vicinity of a black image area of the record data or not; deciding whether the black image is to be formed by the black ink or the color inks in accordance with the determination in one determining step, and forming the black image in accordance with the decision.

The present invention further provides a color ink jet recording apparatus for recording a color image on a recording medium in accordance with record data by using black ink and a plurality of color inks having a different penetration velocity to the recording medium than that of the black ink, comprising: detection means for detecting whether a color image is present in the vicinity of a black image area of the record data or not; and conversion means for converting the record data in the black image area to be adopted for use of the color inks based on a mask pattern prepared pseudo-randomly in accordance with the detection result of the detection means.

The present invention further provides a color ink jet recording apparatus for recording a color image on a recording medium in accordance with record data by using black ink and a plurality of color inks having a different penetration velocity to the recording medium than that of the black ink, comprising: detection means for detecting whether a color image is present in the vicinity of a black image area of the record data or not; and conversion means for converting the record data in the black image area to be adopted for use of the color inks based on a mask pattern having an alternate arrangement of a basic pattern and an inverted pattern of the basic pattern.

The present invention further provides a color ink jet recording apparatus for recording a color image on a recording medium in accordance with record data by using black ink and a plurality of color inks having a different penetration velocity to the recording medium than that of the black ink, comprising: detection means for detecting whether a color image is present in the vicinity of a black image area of the record data or not; and conversion means for converting the record data in the black image area to be adopted for use of the color inks.

In accordance with the present invention, the ink blur is prevented in forming the color image even if images of different colors are adjacent, and the high quality image with high density and without feathering is attained with the second black ink used in forming the black image which is not adjacent to the color image.

In accordance with the present invention, PCBk can be formed without changing the tonality when the black image area is formed by a plurality of color inks. In determining whether color inks are to be used to form the black image area or not, substitution is not conducted if the black image area adjacent to the color image area are continuous. Thus, a significant change of the tonality is prevented.

BRIEF DESCRIPTION OF THE DRAWINGS

FIGS. 17A to 17C illustrate a PCBk substitution by a random mask pattern in the Embodiment 5, FIGS. 18A to 18C illustrate a PCBk substitution by an inverted mask pattern in an Embodiment 6.

DETAILED DESCRIPTION OF THE PREFERRED EMBODIMENTS

Figure 1:
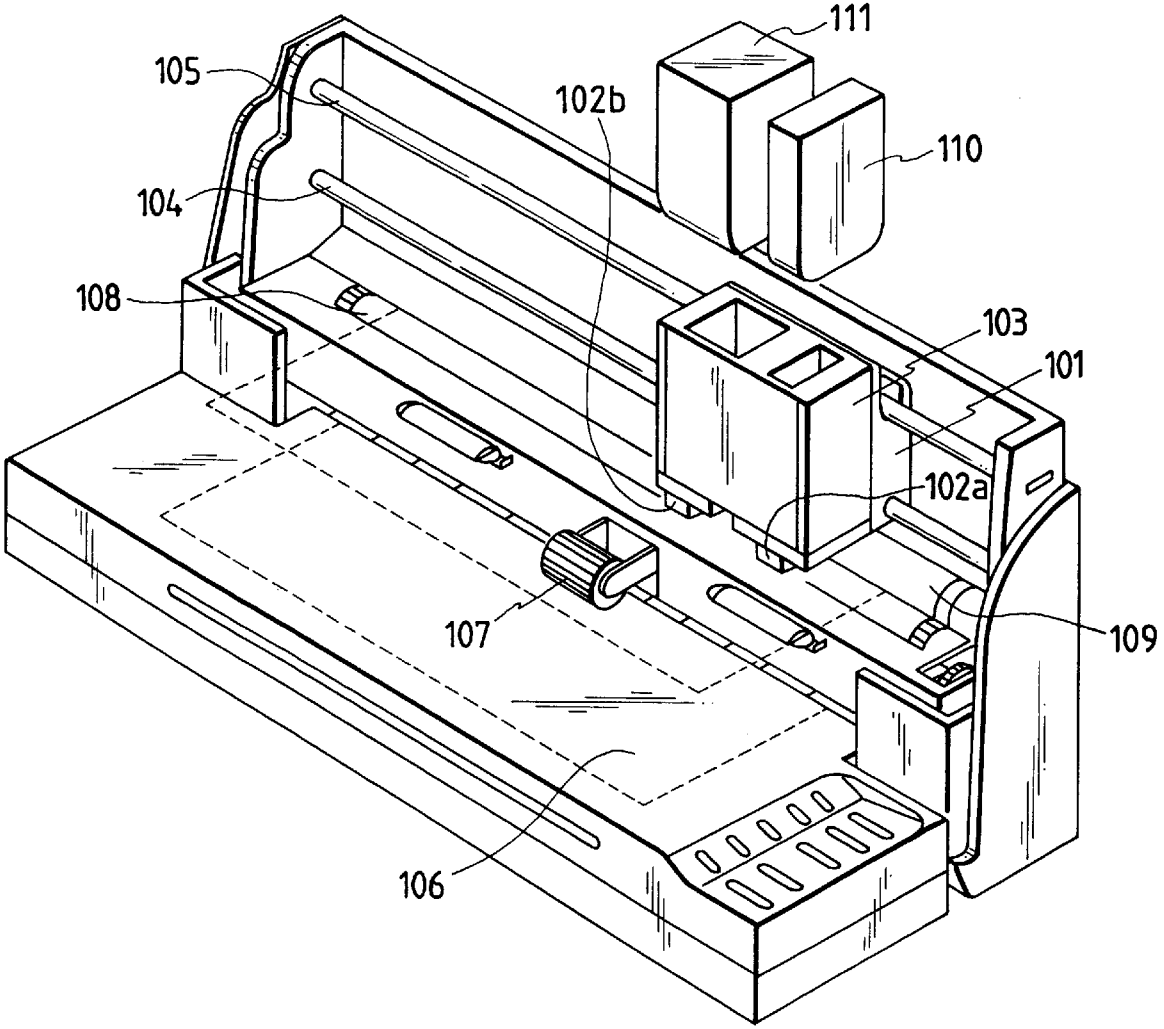
FIG. 1 shows a perspective view of an ink jet recording apparatus to which the present invention is applied.

Referring to the drawings, the embodiment of the present invention are explained in detail. The premises of the examples are first discussed.

Figure 7:
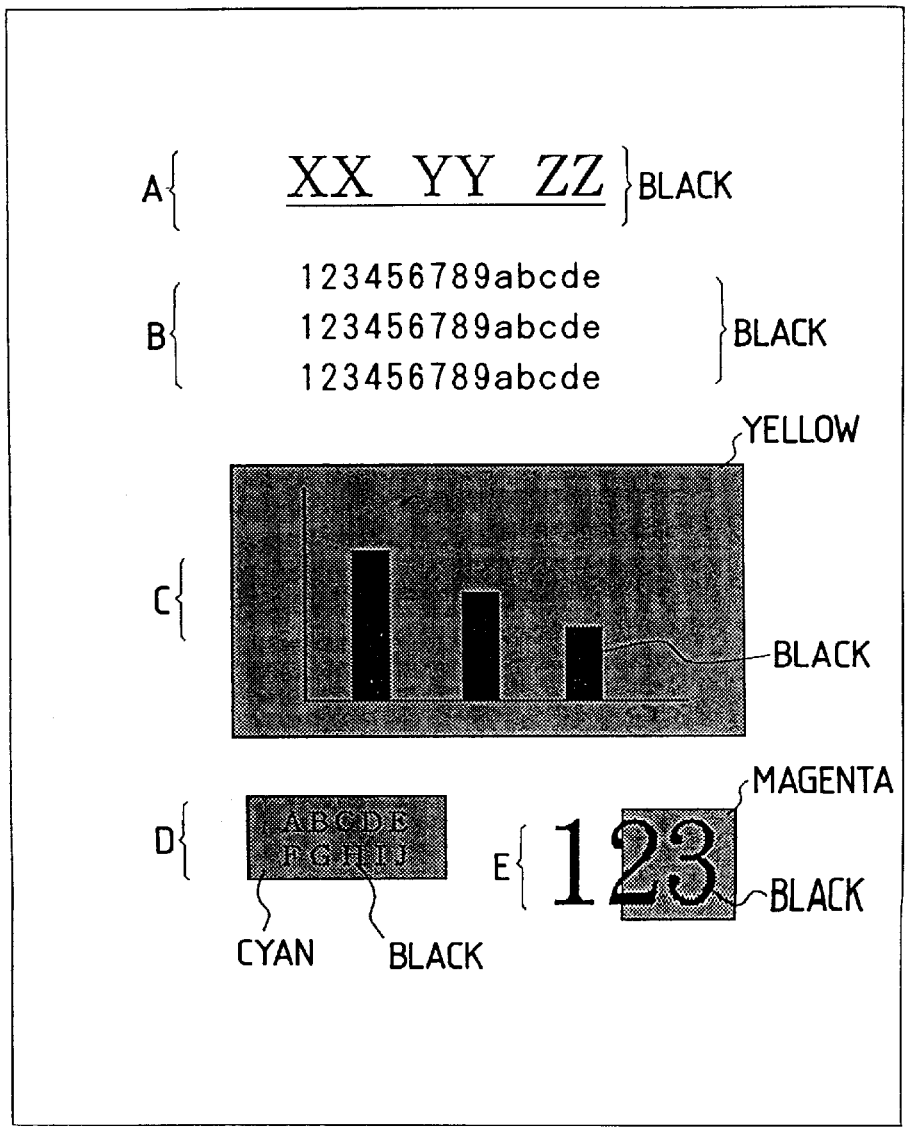
FIG. 7 shows an image for illustrating the present invention.

FIG. 7 shows an image in which black images and color images are present in mixture. An image area A comprises X, Y and Z black enlarged characters and an underscore and it includes bit image data. An image area B includes black character code data. An image area C includes an image of black graph on a yellow background. An image area D includes black character code data on a cyan background. An image area E includes a magenta image on a portion of a background to black bit image data.

In the present invention, a first black ink which has a fast penetration velocity to a recording medium and a second black ink which has a slower penetration velocity than that of the first black ink are used, and whether a color image is present adjacently to a black image or not is determined to determine whether the second black ink is used to form the black image or the first black ink is primarily used to form the black image.

Accordingly, in the image shown in FIG. 7, the image areas C, D and E are the subjects of the present invention. When the present invention is applied to an actual printer, whether the present invention is to be applied to all black images or only to the black character code data may be appropriately determined from the aspect of the processing speed, the cost and the image quality.

The ink which has the fast penetration velocity ink to the recording medium used in the present invention does not cause the color blur in forming the color image even if different color areas are adjacent, and the second black ink used to form the black area which is not adjacent to the color image can attain the high density and feathering free, high quality image.

FIG. 1 shows a perspective view of an ink jet printer applicable to the Embodiments 1 to 4 of the present invention.

A carriage 101 carries recording heads 102*a* and 102*b* and a cartridge guide 103 and it is scanned on guide shafts 104 and 105.

A record sheet 106 is fed into the apparatus by a sheet feed roller 107 and pinched by a sheet feed roller 108, a pinch roller (not shown) and a sheet retainer 109 and fed to an entire surface of the sheet feed roller 108 for printing. Ink cartridges include a color ink cartridge 110 which accommodates four color inks, yellow, magenta, cyan and the first black, which have the fast penetration velocity to the record sheet, and a black ink cartridge 111 which accommodates the second black ink. They are separately inserted in a cartridge 103 to communicate with the recording heads 102*a* and 102*b*.

The yellow, magenta, cyan and first black inks accommodated in the color ink cartridge 110 have the fast penetration velocity to the record sheet so that the ink blur does not occur at the boundary of the colors when the color image is formed. On the other hand, the second black ink accommodated in the black ink cartridge 111 provides the high density black image without the ink blur and provides the high quality.

The composition of the ink used in the present embodiment is as follows:

| | |
|---|---|
| 1. Yellow | |
| C. I. direct yellow 86 | 3 parts |
| diethylene glycol | 10 parts |
| isopropyl alcohol | 2 parts |
| urea | 5 parts |
| acetyrenol EH (Kawaken Chemical) | 1 part |
| water | balance |
| 2. Magenta | |
| C. I. acid red 289 | 3 parts |
| diethylene glycol | 10 parts |
| isopropyl alcohol | 2 parts |
| urea | 5 parts |
| acetyrenol EH (Kawaken Chemical) | 1 part |
| water | balance |
| 3. Cyan | |
| C. I. direct blue 199 | 3 parts |
| diethylene glycol | 10 parts |
| isopropyl alcohol | 2 parts |
| urea | 5 parts |
| acetyrenol EH (Kawaken Chemical) | 1 part |
| water | balance |

-continued

| | |
|---|---|
| 4. First black | |
| C. I. direct black 154 | 3 parts |
| diethylene glycol | 10 parts |
| isopropyl alcohol | 2 parts |
| urea | 5 parts |
| acetyrenol EH (Kawaken Chemical) | 1 part |
| water | balance |
| 5. Second black | |
| C. I. direct black 154 | 3 parts |
| diethylene glycol | 10 parts |
| isopropyl alcohol | 2 parts |
| urea | 5 parts |
| water | balance |

In this manner, for the cyan, magenta, yellow and first black inks, acetyrenol EH is added by 1% relative to the second black ink to enhance the penetration. The additives may additionally include other surface activation agents or alcohols.

Referring to FIGS. 2A to 2D, the recording heads 102*a* and 102*b* are now explained in detail.

Figure 2A:
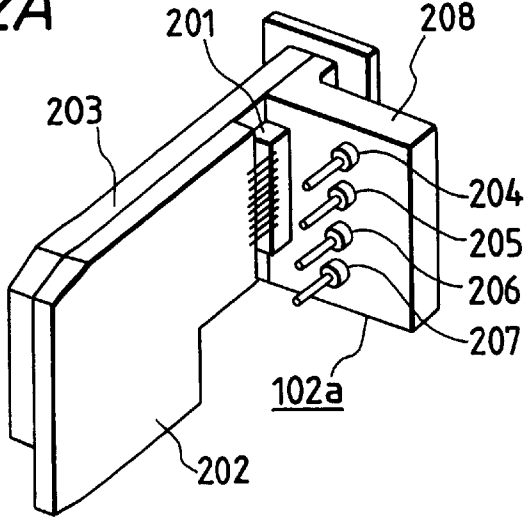
FIGS. 2A to 2D show a head mechanism of the ink et recording apparatus to which the present invention is applied.
Figure 2B:
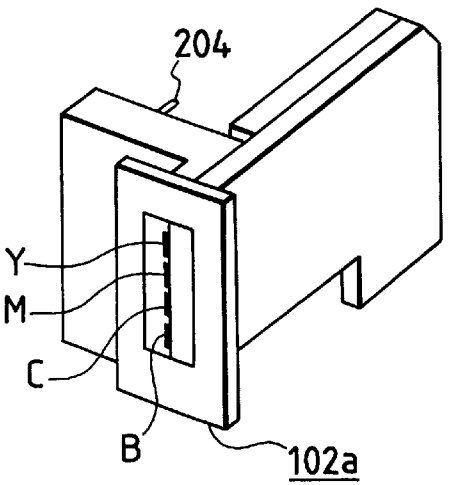

FIGS. 2A and 2B show perspective views of the recording head 102*a*. Groups of discharge ports for the yellow, magenta, cyan and black inks are arranged in a line on a front side. Each group has 24 discharge ports for each of the yellow, magenta, cyan and black inks, and the groups of different colors are separated by no less than a nozzle pitch. In the present embodiment, an 8-nozzle space is provided. The nozzle pitch is 70.5 $\mu$m which corresponds to a resolution of 360 dpi (dots per inch).

Each of the discharge ports is provided with an ink path communicating with the discharge port, and a common liquid chamber for supplying the ink to the ink path is provided behind a position at which the ink path is located. An electro-thermal transducer for generating thermal energy used to discharge ink droplets from the discharge port and electrode wiring for supplying power to the transducer are provided in the ink path corresponding to each discharge port. The electro-thermal transducer and the electrode wiring are formed on a silicon substrate 201 by a film forming technology. A separation wall and a top plate made of resin or glass are laminated on the substrate to complete the discharge ports, the ink paths and the common ink chamber. A drive circuit for driving the electro-thermal transducer by a record signal is formed behind the stack in a form of a printed circuit board.

The silicon substrate 201 and the printed circuit board 202 and the aluminum plate 203 are arranged in parallel, and pipes 204 to 207 extend from a plastic member 208 called a distributor which extends perpendicularly to the silicon substrate. The pipe communicate with the ink paths which communicate with the common ink chamber.

Four ink paths for the yellow, magenta, cyan and black inks are provided in the distributor and connected with the respective common ink chambers and pipes.

Ink of approximately 40 ng is discharged from each of the discharge ports for the yellow, magenta, cyan and black inks provided in the recording head 102*a*.

Figure 2C:
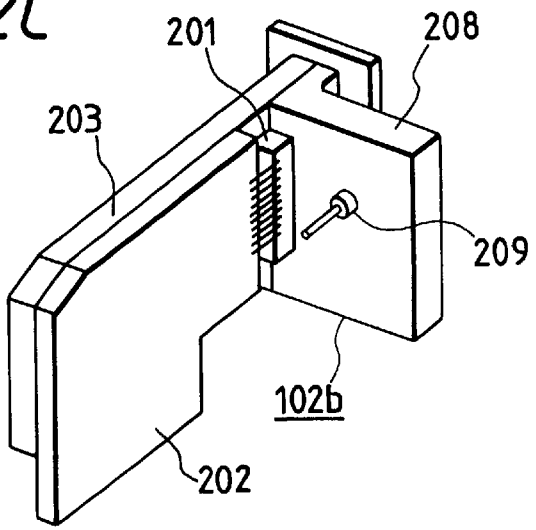
Figure 2D:
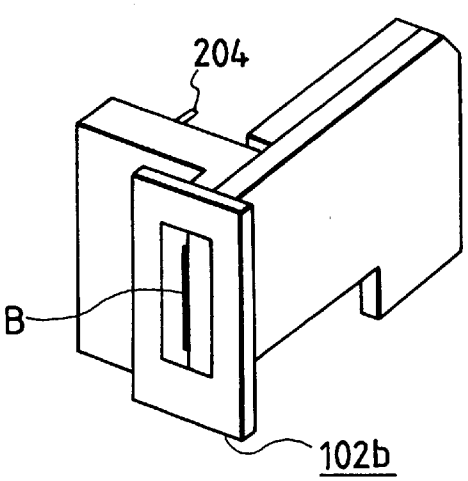

On the other hand, FIGS. 2C and 2D show the recording head 102*b* in which the like elements to those of FIGS. 2A and 2B are designated by the like numerals. 128 discharge ports for the second black ink are formed on the front side of the recording head 102*b* and an ink path communicating with the discharge port is provided for each of the discharge ports as it is in the recording head 102*a*. A common ink chamber for supplying the ink to the ink paths is provided behind a position at which the ink paths are located. Since the recording head 102*b* discharges only the second black ink, only one pipe extends from the distributor 208.

Approximately 80 ng of ink is discharged from each of the black discharge ports formed in the recording head 102*b*.

In the present ink jet printer, the recording head for forming the color image and the recording head for forming the high quality black image are separately provided. Thus, when only the black image is to be printed or the image which is the mixture of the black image and the color image is to be printed, all of the 128 nozzles of the recording head 102*b* can be used to attain the high speed printing if the black images are continuous in the direction of feed of the record sheet as shown by the image areas A and B in FIG. 7.

Figure 3:
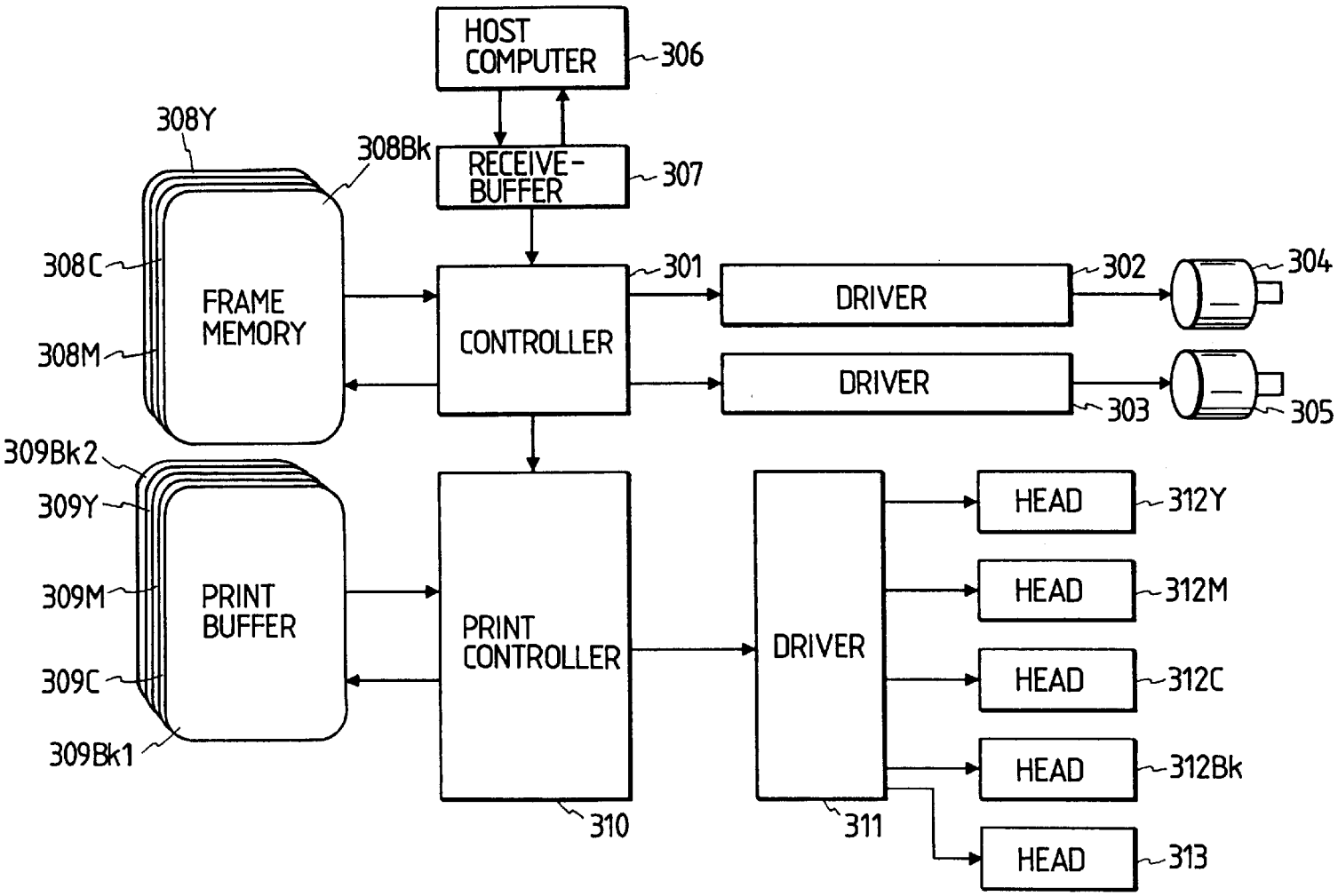
FIG. 3 shows a block diagram of a control circuit of the ink jet recording apparatus to which the present invention is applied.

FIG. 3 shows an electrical control block diagram of the color ink jet printer described above.

Numeral 301 denotes a system controller for controlling the overall apparatus and it includes a microprocessor, a memory (ROM) for storing a control program, and a memory (RAM) used for the processing by the microprocessor. Numeral 302 denotes a driver for driving the print head in a main scan direction, and numeral 303 denotes a driver for driving in a sub-scan direction. Numerals 304 and 305 denote motors for the drivers, which receive information such as velocity and distance to drive from the drivers.

Numeral 306 denotes a host computer which transfers information to be printed by the printer of the present invention. Numeral 307 denotes a receive buffer for temporarily storing data from the host computer 306 and stores it until the data is read from the system controller 301. Numeral 308 denotes a frame memory for developing the data to be printed into image data, and it has a memory size necessary for printing. In the present embodiment, a frame memory which can store one print sheet is explained although the present invention is not restricted by the size of the frame memory.

Numeral 309 denotes a memory (print buffer) for temporarily storing the data to be printed. The memory capacity varies with the number of nozzles of the recording head. Numeral 310 denotes a print controller which properly control the print head by a command from the system controller. It controls the discharge speed and the number of character data. Numeral 311 denotes a driver for driving a nozzle (head) 312Y for discharging the yellow ink, a nozzle (head) 312Y for discharging the magenta ink, a nozzle (head) 312C for discharging the cyan ink, a nozzle (head) 312Bk for discharging the first black ink and a nozzle (head) 313 for discharging the second black ink. It is controlled by the signal from the print controller 310.

[Embodiment 1]

Figure 4:
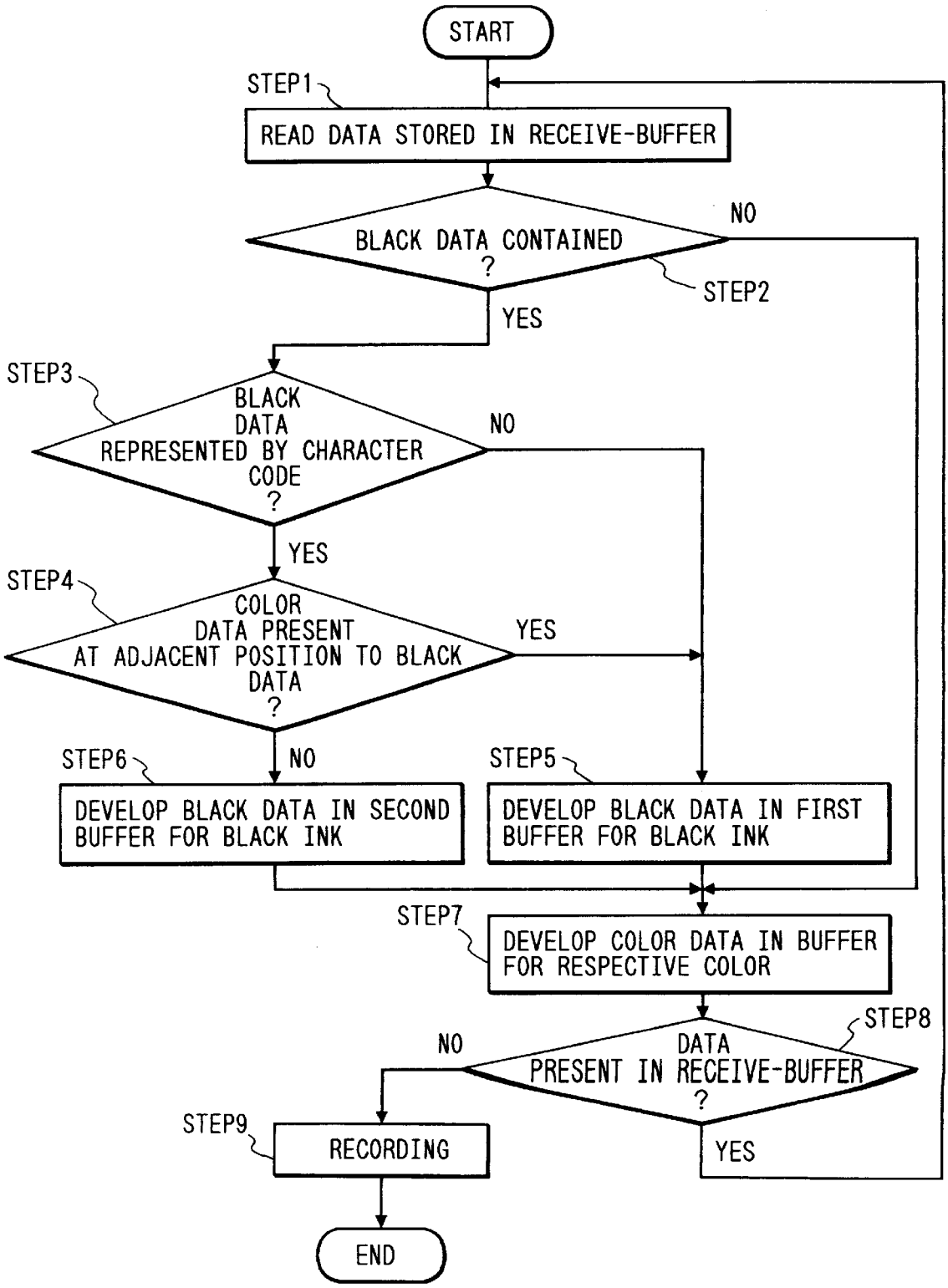
FIG. 4 shows an operation flow of an Embodiment 1, FIGS. 5A to 5F illustate an image forming process of the Embodiment 1.

FIG. 4 shows an operation flow in an Embodiment 1 of the present invention. STEP 1 is a first step in which the data is transferred from the host computer 306 of FIG. 3 and the system controller 301 reads the data stored in the receiver buffer 307 to process it. In STEP 2, whether the read data includes the black data or other than black data is determined. If the black data is included, the process proceeds to STEP 3 and otherwise to STEP 7.

In STEP 3, whether the black image record area in question includes the character code data or the bit image data is determined, and if the character code data is included, the process proceeds to STEP 4, and if the bit image data is included, the process proceeds to STEP 5. In STEP 4, the black data is checked to determine whether color record data is present in pixels at the positions adjacent to the periphery of the black image record area. When the color image is present in the positions adjacent to the black image, the process proceeds to STEP 5, and if it is not present, the process proceeds to STEP 6.

In STEP 5, the black image information which is the character code data and adjacent to which the color image is present, and the black image information which is the bit image data are developed into the first black ink recording buffer 309Bk1. In STEP 6, the black image information is developed into the second black ink recording buffer 309Bk2.

In STEP 7, the Y, M and C color data pending for the development are developed into the color buffers 309Y, 309M and 309C, respectively.

In STEP 8, the data is read from the receive buffer and whether the data to be printed is present or not, or whether one page of data has been received or not is determined. If the data to be printed is not present or when one page of data has been received although the data to be printed is present, the process proceeds to STEP 9. Otherwise, the process returns to STEP 1. In STEP 9, the printing is made by the recording head 102.

Figures 5A, 5B, 5C, 5D, 5E, 5F:
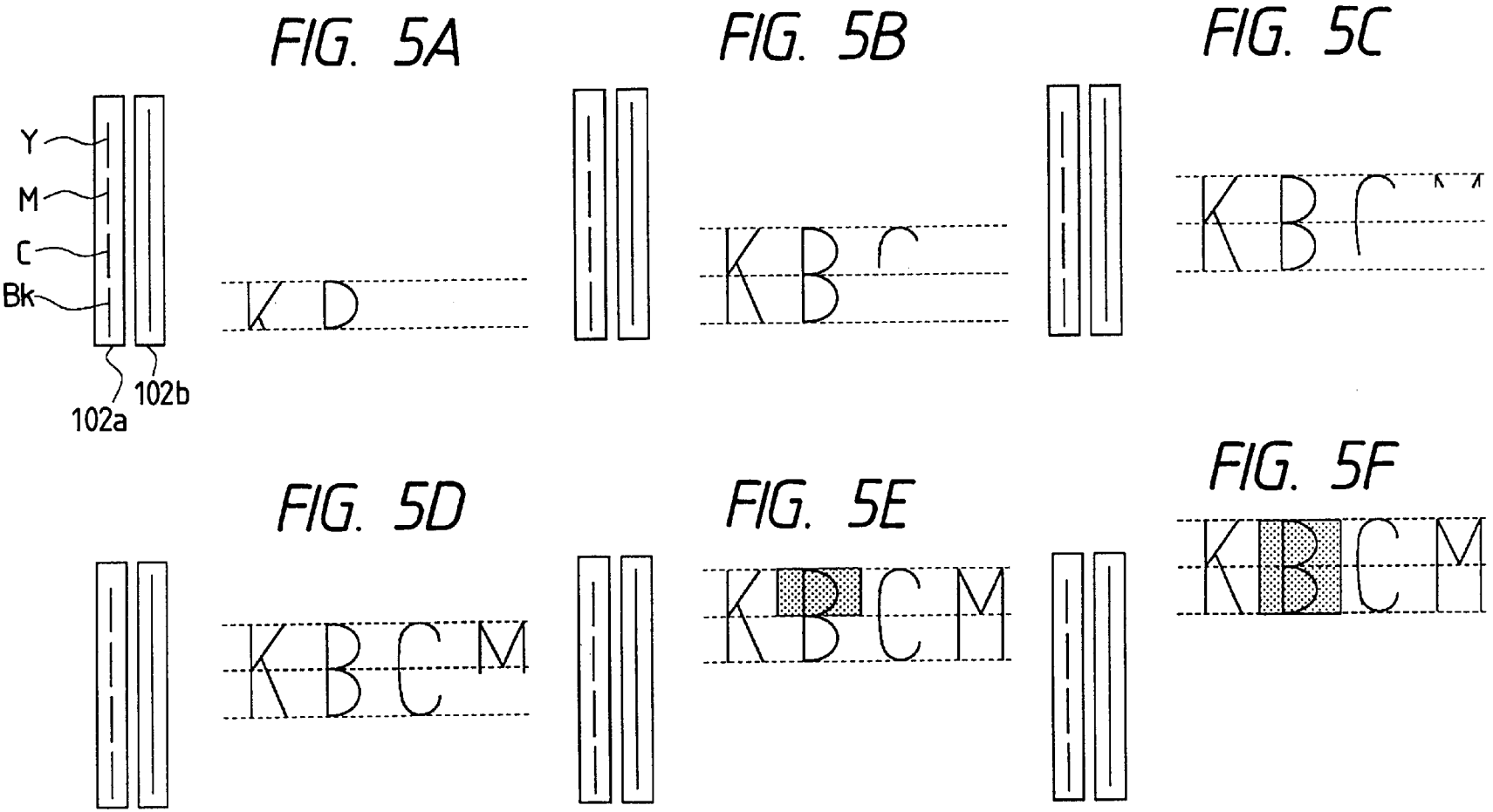

FIGS. 5A to 5F show a process for forming the color image including the black image as shown in FIG. 5F in accordance with the operation flow of the recording apparatus described above. The image of FIG. 5F comprises a black character "K", a black character "B" on a yellow background, a magenta character "M" and a cyan character "C", starting from the left end. These characters are those of a character code.

As shown in FIG. 5A, the black characters are printed by using the recording heads 102*a* and 102*b*. The black character "K" is printed by the recording head 102*b* because it is not adjacent to the color image, and the black character "B" is printed by the recording head 102*a* because it is on the background yellow image. After the upper halves of the respective black characters have been printed, the record sheet is fed by a 24-nozzle width.

Then, as shown in FIG. 5B, the lower halves of the respective black characters are printed and the printing of the black characters is terminated at this step. A portion of the cyan character "C" is simultaneously printed by the recording head 102*a*.

The record sheet is further fed by 24-nozzle width and a portion of the cyan character "C" and a portion of the magenta character "M" are printed as shown in FIG. 5C.

The record sheet is further fed by a 24-nozzle width and the remaining portion of the cyan character "C" and a portion of the magenta character "M" are printed as shown in FIG. 5D.

The record sheet is further fed by a 24-nozzle width and the remaining portion of the magenta character "M" and an upper half of the background yellow image of the black character "B" are printed as shown in FIG. 5E.

The record sheet is further fed by a 24-nozzle width and the lower half of the yellow image is printed as shown in FIG. 5F to complete the entire image formation.

The resulting image is of high density and free from the feathering particularly in the black character "K", and free from the ink blur at the boundary of the background yellow image in the black character "B".

In the present embodiment, whether the black character of the character code is adjacent to the color image or not is determined, and if it is adjacent, the black character is printed by the recording head 102*a* so that the sharp image without the ink blur at the boundary of the color image is formed, and when it is not adjacent, the black character is printed by the recording head 102*b* so that the image with the high quality black character is formed.

[Embodiment 2]

Embodiment 2 is an improvement over the Embodiment 1 to improve the quality of the black character adjacent to the color image.

When the black character adjacent to the color image is to be printed, the second black ink by the recording head 102*b* is used in addition to the first black ink by the recording head 102*a*.

Figure 6:
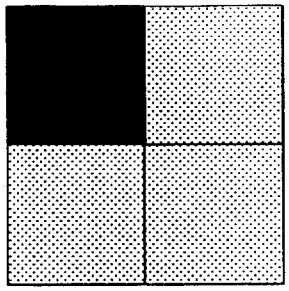
FIG. 6 illustrates an implantation pattern to form a black image in an Embodiment 2.

FIG. 6 shows a manner of implantation. The second black ink is implanted by the recording head 102*b* to the solid painted pixel and the first black ink is implanted by the recording head 102*a* to the three hatched pixels. Since the second black ink has a lower penetration velocity to the record sheet and a larger discharge amount of 80 ng, the density is enhanced and the quality is improved when it is mixed with the first black ink at an appropriate proportion.

In the present embodiment, the second black ink is implanted once for every fourth pixel. If the ratio to implant the second black ink is increased, the quality of the black character is improved but the bleeding with the color image gradually increases and the overall quality tends to decrease. Accordingly, it should be determined by taking the characteristic of the inks used and the drive condition into account.

[Embodiment 3]

Figure 8:
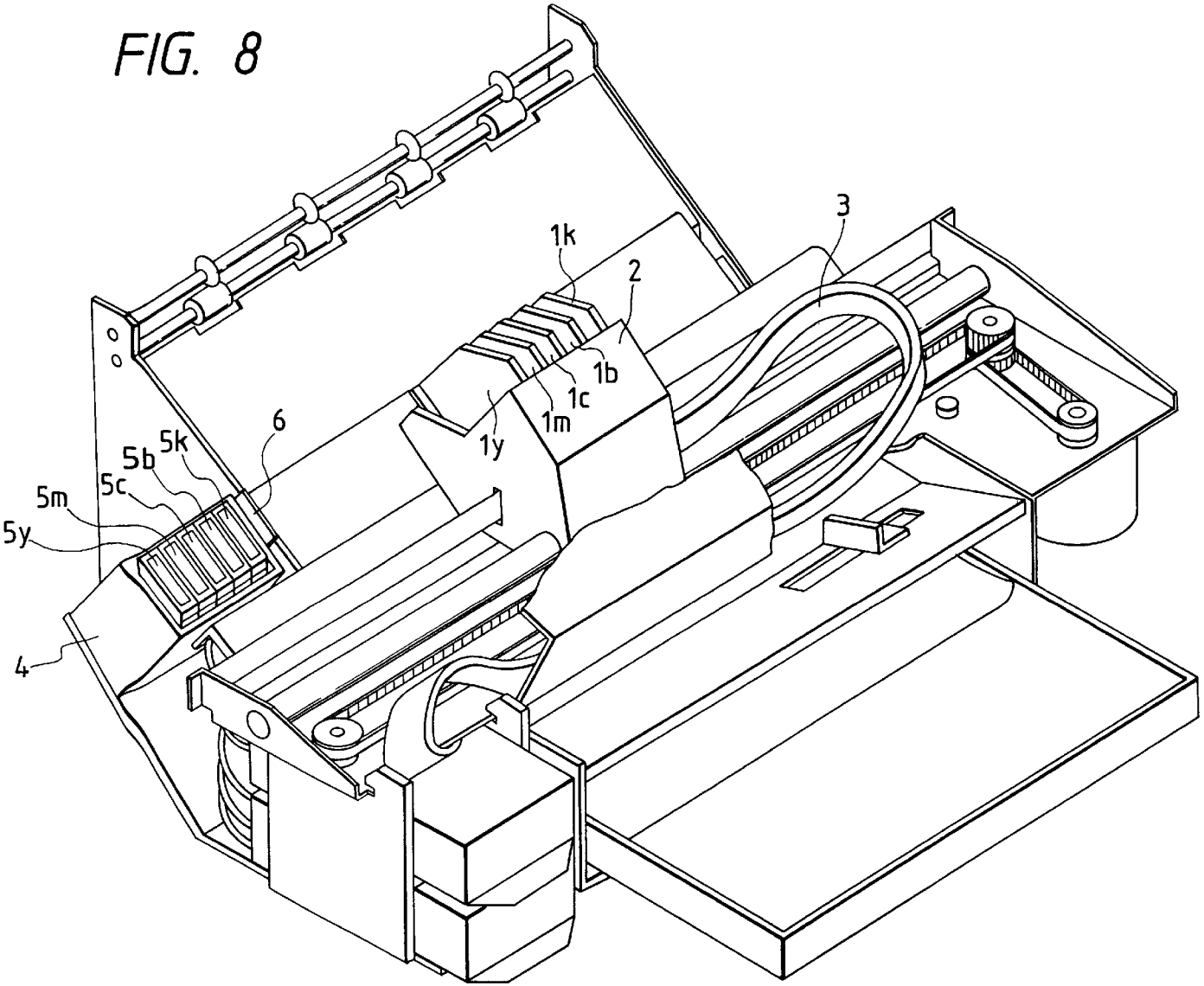
FIG. 8 shows a perspective view of another ink jet recording apparatus to which the present invention is applied.

FIG. 8 shows another color ink jet printer to which the present invention is applied. Numeral 1*y* denotes a yellow ink recording head, numeral 1*m* denotes a magenta ink recording head, numeral 1*c* denotes a cyan ink recording head, numeral 1*b* denotes a first black ink recording head, numeral 1*k* denotes a second black ink recording head, numeral 2 denotes a carriage for carrying the recording heads, numeral 3 denotes a flexible cable through which electrical signals are sent from a printer main body to the recording heads, numeral 4 denotes a cap unit having recovery means, numerals 5*y*, 5*m*, 5*c*, 5*b* and 5*k* denote cap members for the recording heads 1*y*, 1*m*, 1*c*, 1*b* and 1*k*, respectively, and numeral 6 denotes a wiper blade made of rubber.

The construction of the recording heads 1*y*, 1*m*, 1*c* and 1*b* are basically identical to that of the recording head 102*b* shown in the Embodiment 1 and each head has 128 discharge ports. They differ from the Embodiment 1 in that approximately 40 ng of ink is discharged from each nozzle. The fast penetration velocity ink to the record sheet used for the recording head 102*a* of the Embodiment 1 is used for those recording heads. The recording head 1*k* has 128 nozzles as the recording head 102*b* of the Embodiment 1 does and approximately 80 ng of ink is discharged from each nozzle. The same ink as that used for the recording head 102*b* of the Embodiment 1 is used for the recording head 1*k*.

The electrical control in the present embodiment is essentially same as that of the Embodiment 1 and the explanation thereof is omitted.

Figure 9:
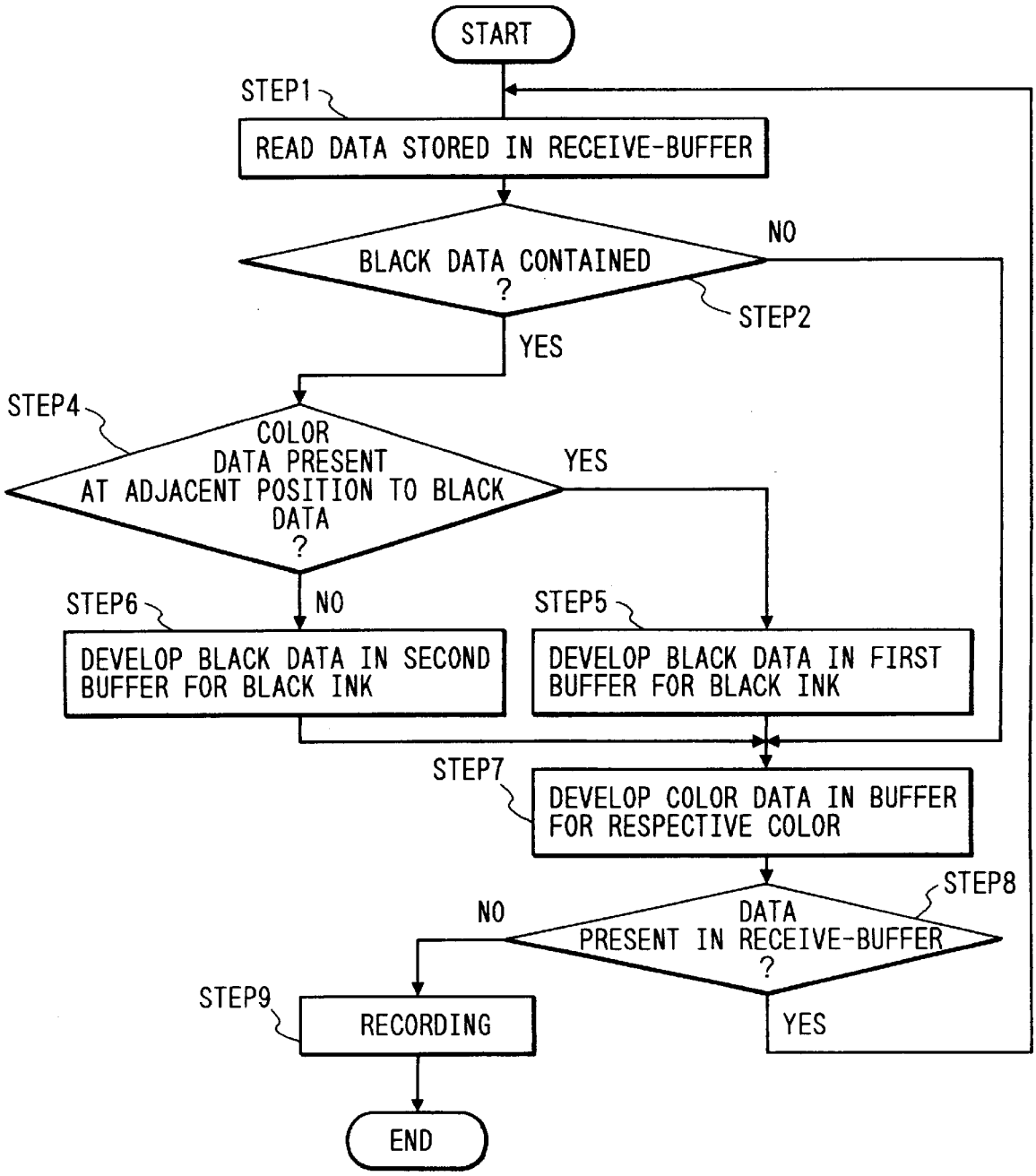
FIG. 9 shows an operation flow of an Embodiment 3.

FIG. 9 shows a basic operation flow of the present embodiment. It differs from the Embodiment 1 in that the determination as to whether the black image is adjacent to the color image or not is made for not only the character code but also for the bit image data. Accordingly, in STEP 3 of the operation flow of FIG. 4 in which whether the black data is the character code or not is determined is not included in the operation flow of FIG. 9.

A feature of the present embodiment resides in that the recording time is shorter because the recording heads of the same size are arranged in parallel. Further, since whether the black image is adjacent to the color image or not is determined for the entire black image, the second black ink is used even for the black bit image data which is not adjacent to the color image so that the high quality image is attained.

[Embodiment 4]

Figure 10:
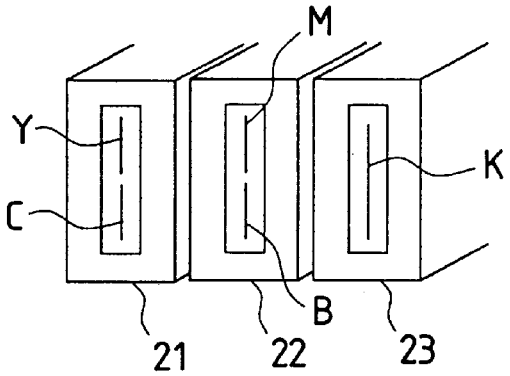
FIG. 10 shows a construction of a recording head used in an Embodiment 4.

FIG. 10 shows a construction of the recording head used in the present embodiment. Each of the recording heads 21 and 22 discharges inks of two different colors having the fast penetration velocity to the record sheet. Namely, the recording head 21 discharges the yellow ink and the cyan ink and the recording head 22 discharges the magenta ink and the first black ink. 32 discharge ports are provided to discharge the ink of each color and an 8-nozzle space is provided between the different colors. Each discharge port discharges approximately 40 ng of ink.

The recording head 23 discharges the second black ink and has 64 discharge ports, and approximately 80 ng of ink is discharged from each port.

FIGS. 11A to 11D illustrate a process to form a color image by using the recording head constructed as shown in FIG. 10.

Figure 11A:
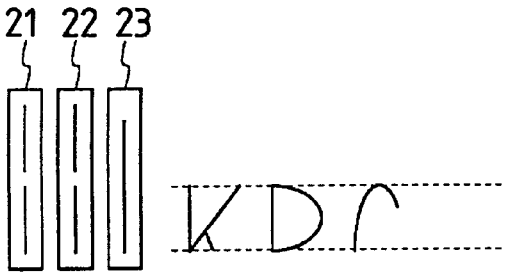
FIGS. 11A to 11D illustrate an image forming process in the Embodiment 4.

As shown in FIG. 11A, an upper half of the black character "K" is printed by using the recording head 23, an upper half of the black character "B" is printed by using the recording head 22, and an upper half of the cyan character "C" is printed by using the recording head 21.

Figure 11B:
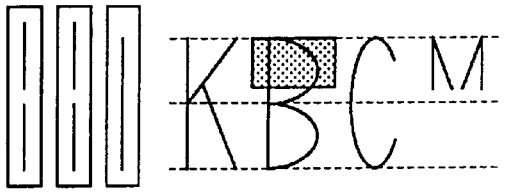

After the record sheet has been fed by a 32-nozzle width, the lower half of the black character "K" is printed by using the recording head 23, the lower half of the black character "B" is printed by using the recording head 22, and the lower half of the cyan character "C" is printed by using the recording head 21 as shown in FIG. 11B, and the printing of the black character and the cyan character is terminated. A portion of the magenta character "M" is also printed by the recording head 22 and a portion of the background yellow image of the black character "B" is also printed by the recording head 21.

Figure 11C:
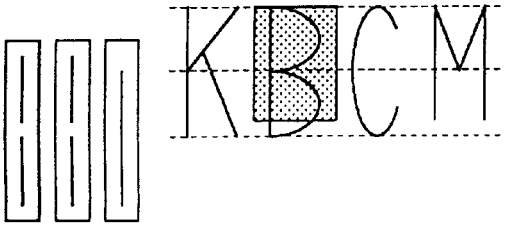

Then, the record sheet is fed by a 32-nozzle width, and a portion of the magenta character "M" is printed by the recording head 22 and a portion of the yellow image is printed by the recording head 21 as shown in FIG. 11C.

Figure 11D:
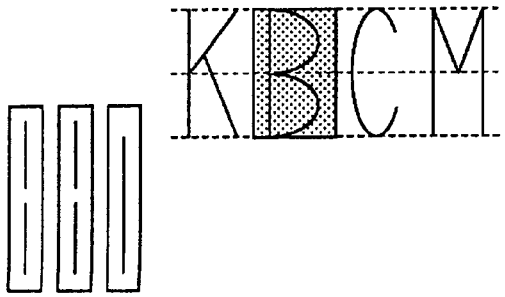

The image is then formed as shown in FIG. 11D.

In the present embodiment, like in the Embodiment 3, whether the black image is adjacent to the color image or not is determined for the entire black image to attain the high quality color image.

While the present invention has been described by the preferred embodiments, it should be understood that the present invention is not limited thereto. For example, the black image which is adjacent to the color image may be printed by the first ink, the mixture of the first black ink and the second black ink or even the mixture of the first black ink and a color ink of an appropriate proportion. The recording head need not be separated into a plurality of units but a single recording head may discharge five different inks.

In accordance with the Embodiments 1 to 4, the ink blur of the black ink and other color ink (yellow, magenta or cyan) can be reduce while maintaining the quality of characters.

[Embodiment 5]

Before the present embodiment is described, a copending U.S. patent application Ser. No. 094,894 filed on Jul. 22, 1993 is first explained. In the copending application, it has been proposed to overprint the color inks in the black area along the boundary of the black and the color to prevent the blur at the boundary of the black and the color. The black formed by the color inks is referred to as PCBk (process color black). In this method, the tonalities of the black area formed by the color inks and the black area formed by the mixture of the black and the color at a predetermined proportion raise a problem.

Figure 21:
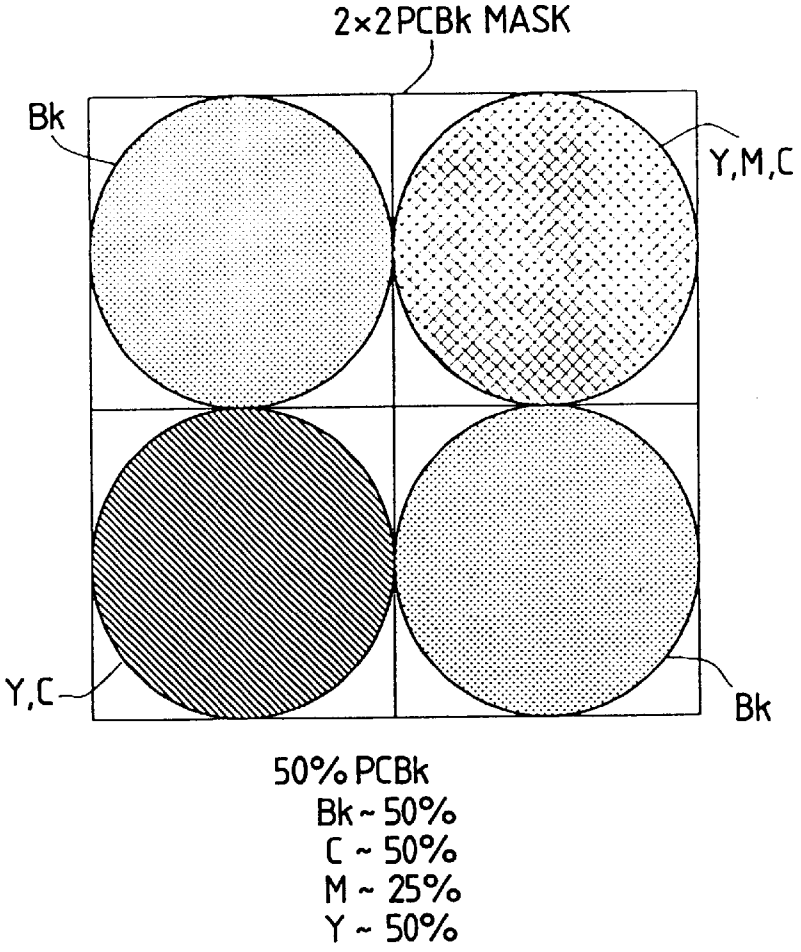
FIG. 21 shows a basic pattern of a PCBk mask used in the PCBk substitution.

In the above method of substituting (or displacing) the black at the boundary by the PCBk, it is a simplest way to form the image by applying a specific mask pattern when the black data is substituted (or displaced) by the color data. An example is shown in FIG. 21. It shows a substitution mask pattern when Bk 100% is substituted by

| | |
|---|---|
| Bk | 50% |
| C | 50% |
| M | 25% |
| Y | 50% |

When a fixed substitution mask as shown in FIG. 21 is used, the tonality of the PCBk formed by the substituting black data changes. A specific example is shown in FIGS. 22A to 22C.

Figures 22A, 22B, 22C:
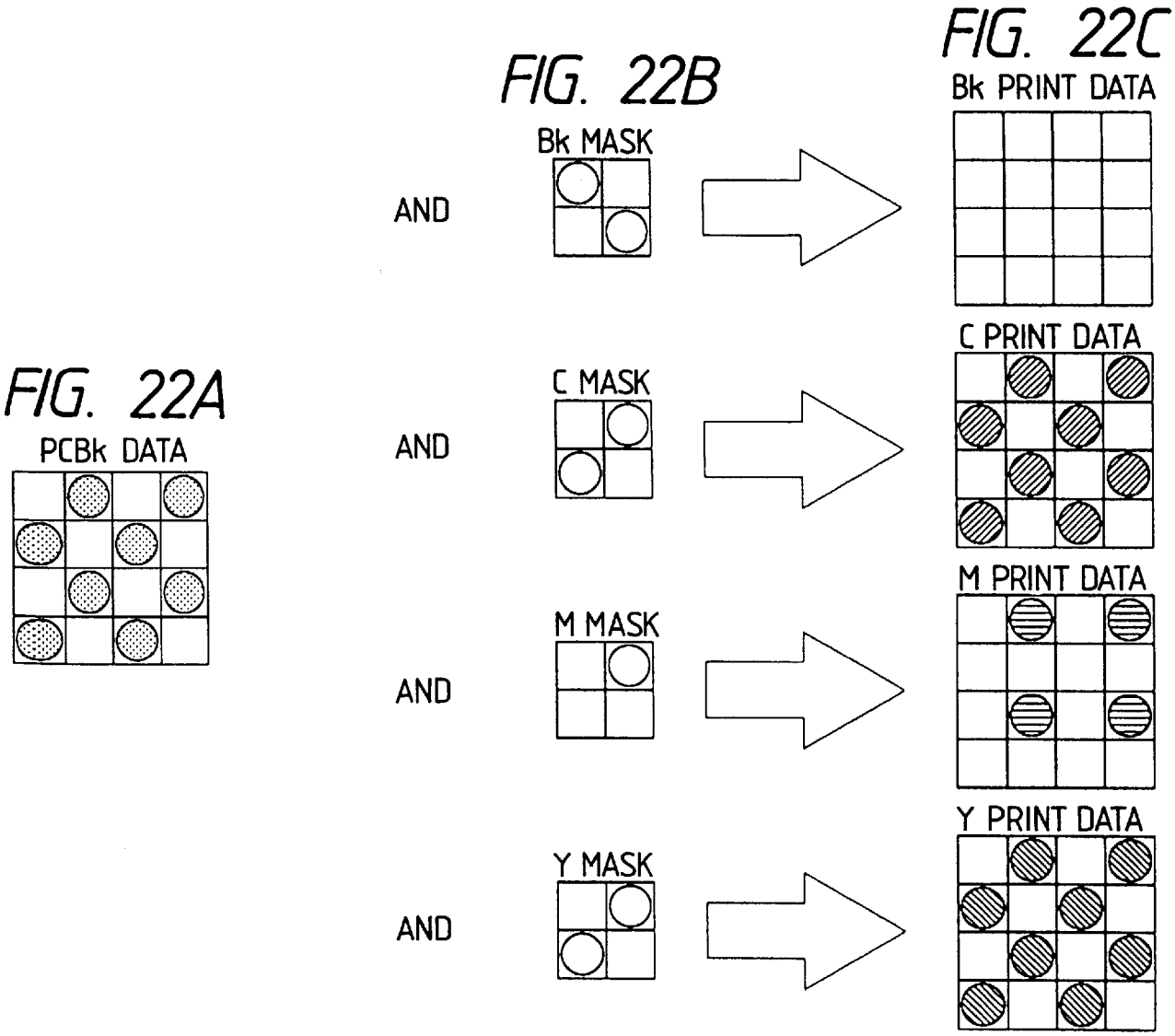
FIGS. 22A to 22C illustrate synchronization of print data and the PCBk mask in the PCBk substitution.

When the PCBk is formed by substituting by the mask (FIG. 22B) shown in FIG. 21 for the substituting black data of 50% duty (FIG. 22A), the PCBk is formed by only Y, M and C (FIG. 22C). If the PCBk includes Bk, the shift of the tonality is small but if the PCBk include only Y, M and C, the shift is substantial. The shift depends on the black data at the boundary and it is recognized by a user as a defect in the image.

The following Embodiments 5 to 8 are intended to overcome the above problem. The features of the respective Embodiments are discussed below.

Figure 12:
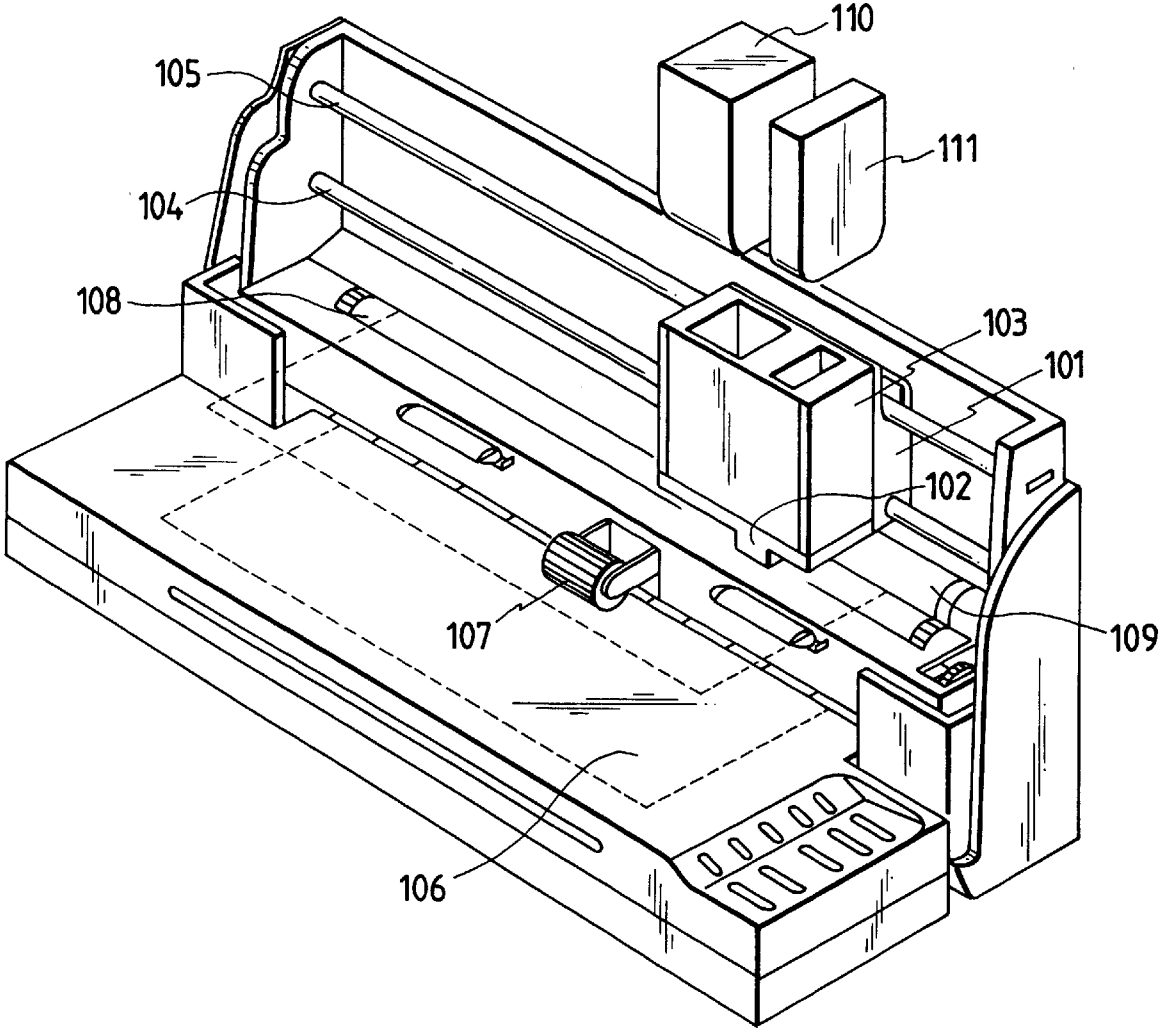
FIG. 12 shows a perspective view of an ink jet recording apparatus to which the present invention is applied.

FIG. 12 shows a perspective view of the recording apparatus which embodies the ink jet recording method of the present invention. The same elements as those shown in FIG. 1 are not described.

An ink cartridge comprises a color in cartridge 110 which accommodates three color inks, yellow, magenta and cyan, and a black ink cartridge 111. They are separately inserted in a cartridge 103 and communicate with a recording head 102.

The yellow, magenta and cyan inks accommodated in the color ink cartridge 110 have a fast penetration velocity to the record sheet to prevent the blur of the ink at the boundary of the colors when the color image is formed. On the other hand, the black ink accommodated in the black ink cartridge 111 has the relatively slow penetration velocity to the record sheet compared to that of the three color inks so that the black image is of high density and high quality with less ink blur.

Figure 13A:
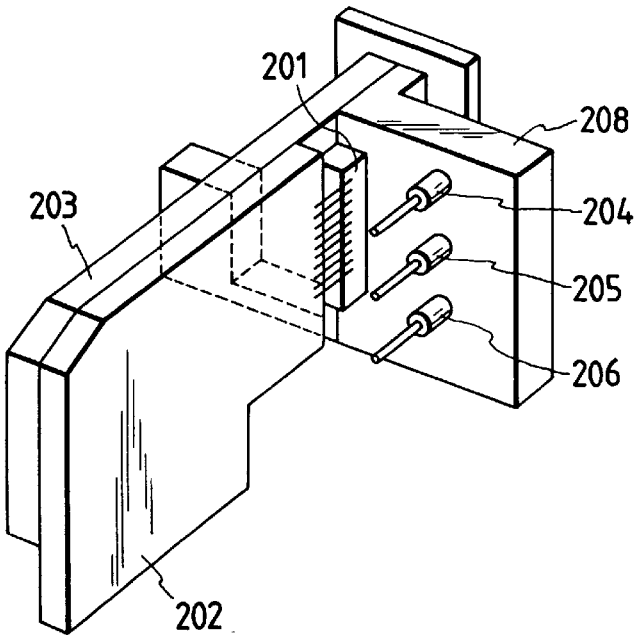
FIGS. 13A and 13B show a head mechanism of the ink jet recording apparatus to which the present invention is applied.
Figure 13B:
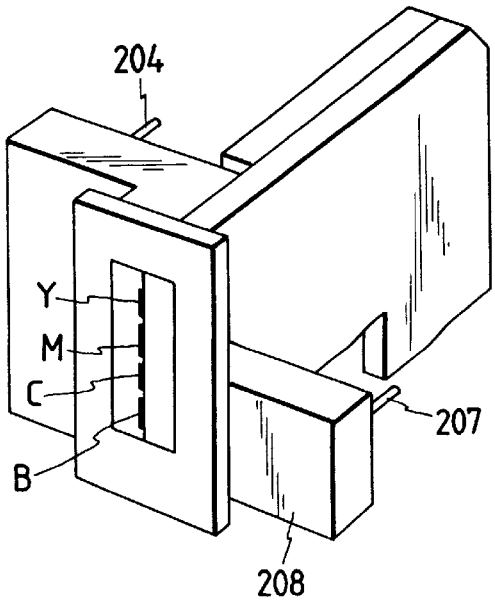

FIGS. 13A and 13B show the recording head 102. The yellow, magenta, cyan and black discharge groups are arranged in a line in the front side of the recording head 102. Each group has 24 discharge ports for each of the yellow, magenta and cyan inks and 64 discharge ports for the black inks, and a space of no less than the nozzle pitch is provide between colors. The nozzle pitch is 70.5 $\mu$m corresponding to a resolution of 360 dpi (dots per inch).

In the present embodiment, the independent ink tanks for the color inks and the black ink are replaceable although a disposable type recording head having an integral ink tank/print head may be used.

Approximately 40 ng of ink is discharged from each of the yellow, magenta and cyan discharge ports provided in the recording head 102, and approximately 80 ng of ink is discharged from the black discharge port.

The composition of the ink used in the present embodiment is the same as that of the color inks of the Embodiment 1 for the color inks, and black ink composition is the same as that of the second black ink of the Embodiment 1.

By adding 1% of acetyrenol EH to the cyan, magenta and yellow inks relative to the black ink, the penetration is enhanced. The additives may further include surface activation agent or alcohol.

Figure 14:
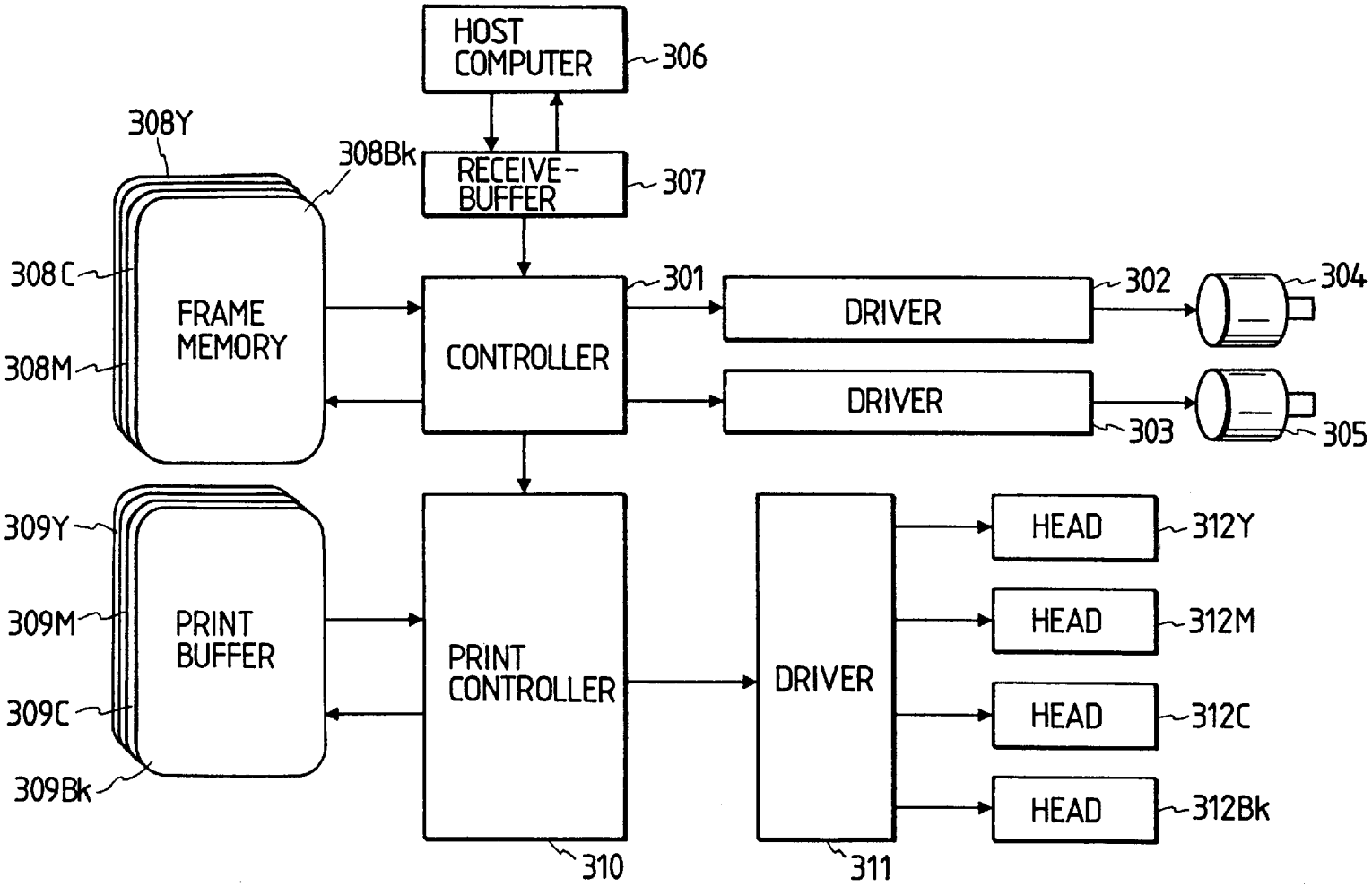
FIG. 14 shows a block diagram of a control circuit of the ink jet recording apparatus to which the present invention is applied.

FIG. 14 shows an electrical control block diagram of the color ink jet printer.

Numeral 309 denotes a memory (print buffer) for temporarily storing the data to be printed. The memory capacity varies with the number of nozzles of the recording head. Numeral 310 denotes a print controller for controlling the print head by a command from the system controller and controlling the discharge speed and the number of print data. Numeral 311 denotes a driver for driving a nozzle (head) 312Y for discharging the yellow ink, a nozzle (head) 312M for discharging the magenta ink, a nozzle (head) 312C for discharging the cyan ink and a nozzle (head) 312Bk for discharging the black ink, and it is controlled by signals from the print controller 310.

Figure 15:
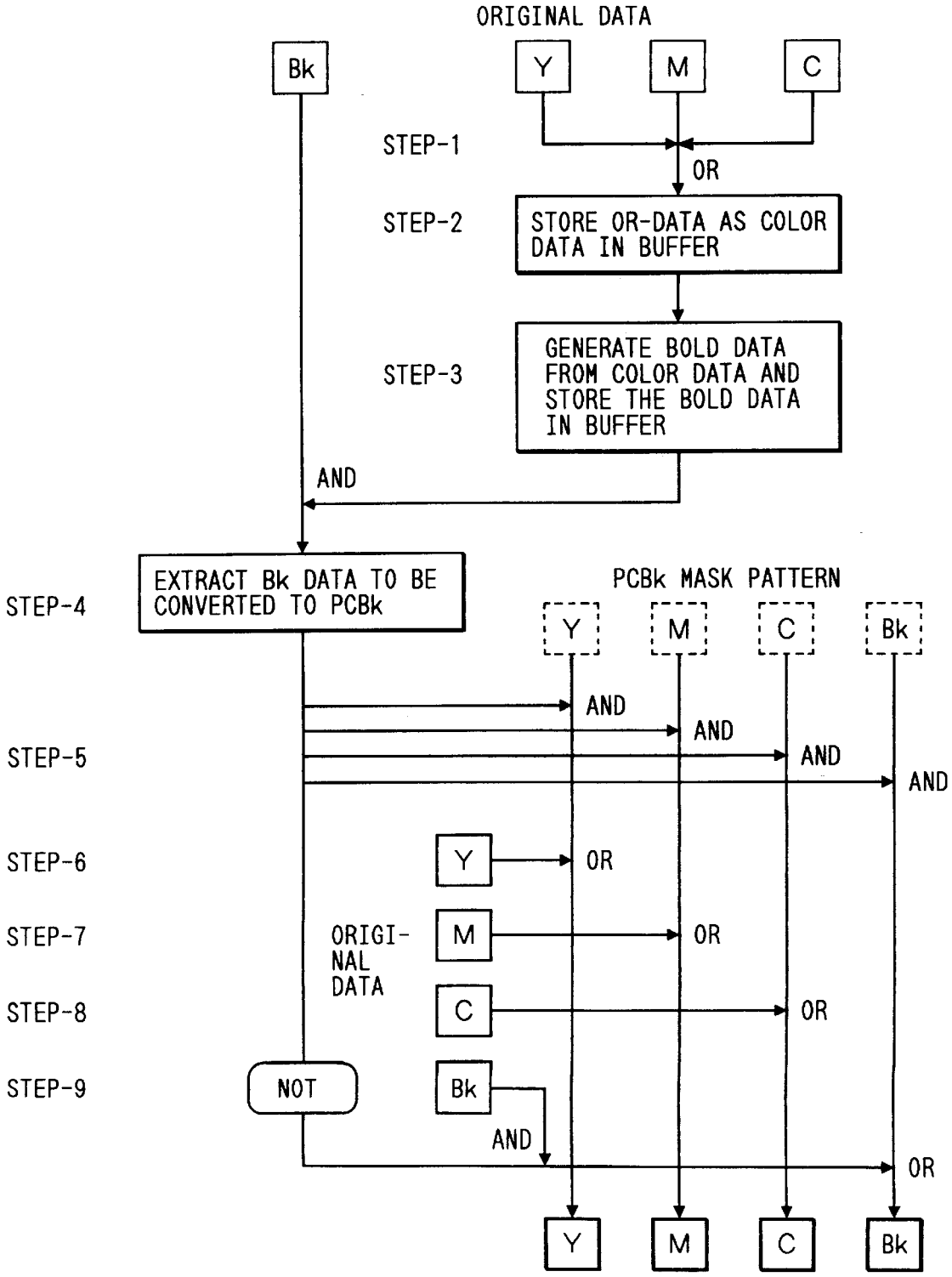
FIG. 15 shows a boundary detection sequence for implementing the present invention.

FIG. 15 shows a boundary detection sequence for detecting the black image area which contacts the color image area in the present embodiment.

In Step 1, of the image original data of the respect colors (Bk, Y, M and C) to be recorded, the Y, M and C data are ORed to form a color data area. In Step 2, the ORed data of the Y, M and C data is temporarily stored in the buffer as the color data.

In a Step 3, the color data is expanded by 4 bits upward, downward, leftward and rightward to generate a bold data and it is temporarily stored in the buffer. This is conducted by using a drag shift which is a function of a gate array in which the address is shifted and ORed with the base data to bold it in the shift direction. It is effected for the four bits of the upward, downward, leftward and rightward bits to generate the color data which is bolded by four bits in upward, downward, leftward and rightward directions.

In Step 4, the color bolded data and the Bk original data are ANDed to detect the boundary and it is extracted as the Bk data for converting to the PCBk of the boundary.

In Step 5, the extracted PCBk conversion data is ANDed with the PCBk mask pattern (conversion mask) which is set for each color to generate data to be added to generate the PCBk. The PCBk mask pattern will be described later.

In Steps 6, 7 and 8, the newly generated PCBk data of the respective colors are ORed with the original data to generate the final image data. Since the PCBk is originally generated from the Bk data, it is necessary to remove the data substituted to the PCBk from the original data. In Step 9, the PCBk data is inverted and it is ANDed with the Bk original data to remove the PCBk data from the original data, and it is further ORed with the BK PCBk data to generate the final BK image data.

The present sequence can control the width (area) of substitution by changing the amount of bold of the color data. By effecting the sequence in multi-step, the directivity of the boundary of the black image area and the color image area can be detected. Further, by separately detecting the boundaries of the respective colors and the Bk, the PCBk appropriate to the respective colors may be set.

In the Embodiment 5, the random mask is used in generating the PCBk so that the PCBk is arranged in a random sequence and the change in the tonality is hard to be recognized.

Figure 16:
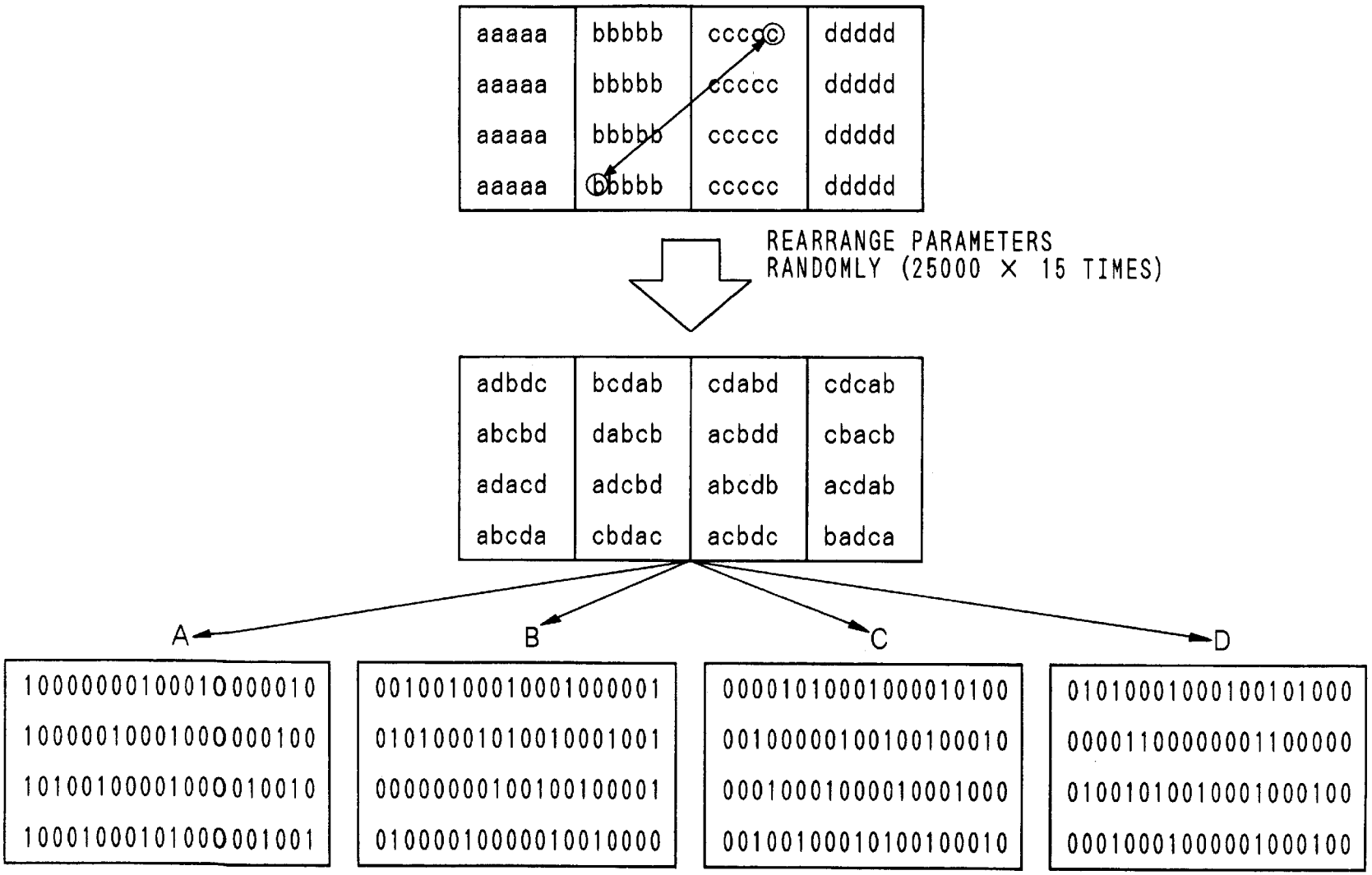
FIG. 16 shows a block diagram for illustrating a random mask pattern generation method in an Embodiment 5.

FIG. 16 shows a block diagram of the random mask pattern generation. In the present embodiment, the generation of the 25% mask pattern is explained. First, a mask of a predetermined size is set, and it is filled with the same number of four parameters (a, b, c and d). The parameters are randomly selected and replaced (substituted). It is conducted a plurality of times to prepare a mask having the parameters randomly arranged. The number of times of replacement may be any number so long as it is sufficient to provide the randomness. In the present embodiment, it is 25000×15 times.

The random arrangement of parameters is stored in the ROM and extracted masks are prepared therefrom. For example, the parameters a, b, c and d corresponds to the masks A, B, C and D, respectively and the bits are set only at the position corresponding to the parameters. Since the parameters are arranged randomly, the masks prepared are also random mask patterns having the random arrangement. Further, since they are originated from the single mask, the random mask patterns which allow 100% interpolation are attained. The scan is conducted by the CPU and the prepared masks are stored in the RAM.

In FIG. 16, one parameter corresponds to one mask. When the PCBk which includes 50% Bk as shown in FIG. 21 is to be prepared, one mask may be prepared from a plurality of parameters. Specifically, in FIG. 16, the mask Bk is prepared from the parameters a and b. Since one parameter is 25%, the 50% Bk mask is prepared. Further, the 50% masks Y and C are prepared from the parameters c and d and the 25% mask M is prepared from one of the parameters c and d. The resulting PCBk is 50% Bk, 50% C, 25% M and 50% Y as shown in FIG. 21.

By using the random mask described above as the PCBk mask pattern, the change in the tonality of the PCBk can be rendered hard to recognize. Various forms of data to be substituted to the PCBk are anticipated. If the PCBk is prepared by the mask pattern having a specific period to the print data, the print data and the mask pattern may synchronize and the color of the generated PCBk may be biased. In an image which creates the tonality by mixing the colors to the Bk at a predetermined ratio as is frequently used in the business graphics, the synchronization appears as the shift of the tonality.

However, when the PCBk is generated by the random mask, there may be the synchronization when viewed in micro but it does not appear continuously so that in macro the tonality of the PCBk is maintained. Accordingly, the tonality can be maintained in the finally formed image.

As a specific embodiment the PCBk generated by the random mask pattern is shown in FIGS. 17A and 17B. The mask pattern is generated in the same manner as that of FIG. 16 (FIG. 17B). As shown in FIGS. 22A to 22C, the data is biased when the specific mask pattern is used, but in FIG. 16, the respective colors are generated at the respective ratios. So long as the mask does not synchronize with the print data, that is, so long as the mask of the present embodiment is used, the print data of the respective colors are not biased in the generated PCBk (FIG. 17C).

By using the random mask pattern as the PCBk generation mask, the PCBk may be generated while preventing the change in the tonality when the black image area which contacts the color image area is recorded so that the blur is suppressed. Further, in the normal black image area, the Bk ink which can attain the high record quality with less feathering may be used. Namely, the compatibility of the high quality black record and the high quality color record is attained.

[Embodiment 6]

In an Embodiment 6, when the data to be substituted to the PCBk is in the form of binary, particularly Bayer type data, the basic mask is inverted and it is used as the PCBk mask. The present embodiment relates to a PCBk generation method when the print data processed by the Bayer type binarization which is a conventional binarization process is used as the PCBk data.

The basic boundary detection sequence is same as that of the Embodiment 5. The mask used to generate the PCBk is inverted. The basic mask is 50% PCBk mask pattern shown in FIG. 21. This basic mask is stored in the ROM and when it is used, the mask as it is and the inverted mask are combined into one mask pattern. By using the inverted mask, the synchronization of the PCBk data and the mask pattern is prevented. In addition, the basic mask pattern is a most basic 2×2 mask pattern.

An example of the PCBk substitution by using the inverted mask is shown in FIGS. 18A to 18C. The PCBk data is same as that of FIG. 22A. By using the inversion process (FIG. 18B) in spite of the fact that the basic mask pattern is used, the final print data (FIG. 18C) has the preset ratios of the colors and the print data is not biased as it is in FIG. 22C.

By inverting the PCBk generation mask from the basic mask pattern, the data of the respective colors to be printed may be divided without changing the tonality in the PCBk when the black image area which contacts to the color image area is recorded. Thus, the blur in the boundary can be suppressed and the change in the tonality of the PCBk is prevented. The mask pattern used is simple in construction and a large memory capacity of the ROM is not required, and it is advantageous in terms of cost.

[Embodiment 7]

In an Embodiment 7, whether the black data pattern detected as the boundary of the color image area and the black image area is continuous or not is recognized to determine whether the PCBk substitution is to be made or not.

In the present embodiment, the basic 2×2 mask shown in FIG. 21 is used as the PCBk mask pattern. Accordingly, the print data to be substituted to the PCBk and the PCBk mask may synchronize. Further, the discrete point at the boundary may be substituted.

The blur at the boundary is hard to occur if the amount of continuous black ink is small, and it is not prominent even if it occurs. Accordingly, if the black boundary is not continuous, the PCBk substitution (or displacement) need not be conducted and it is rather preferable that the PCBk substitution is not conducted in order to maintain the tonality.

Figure 19:
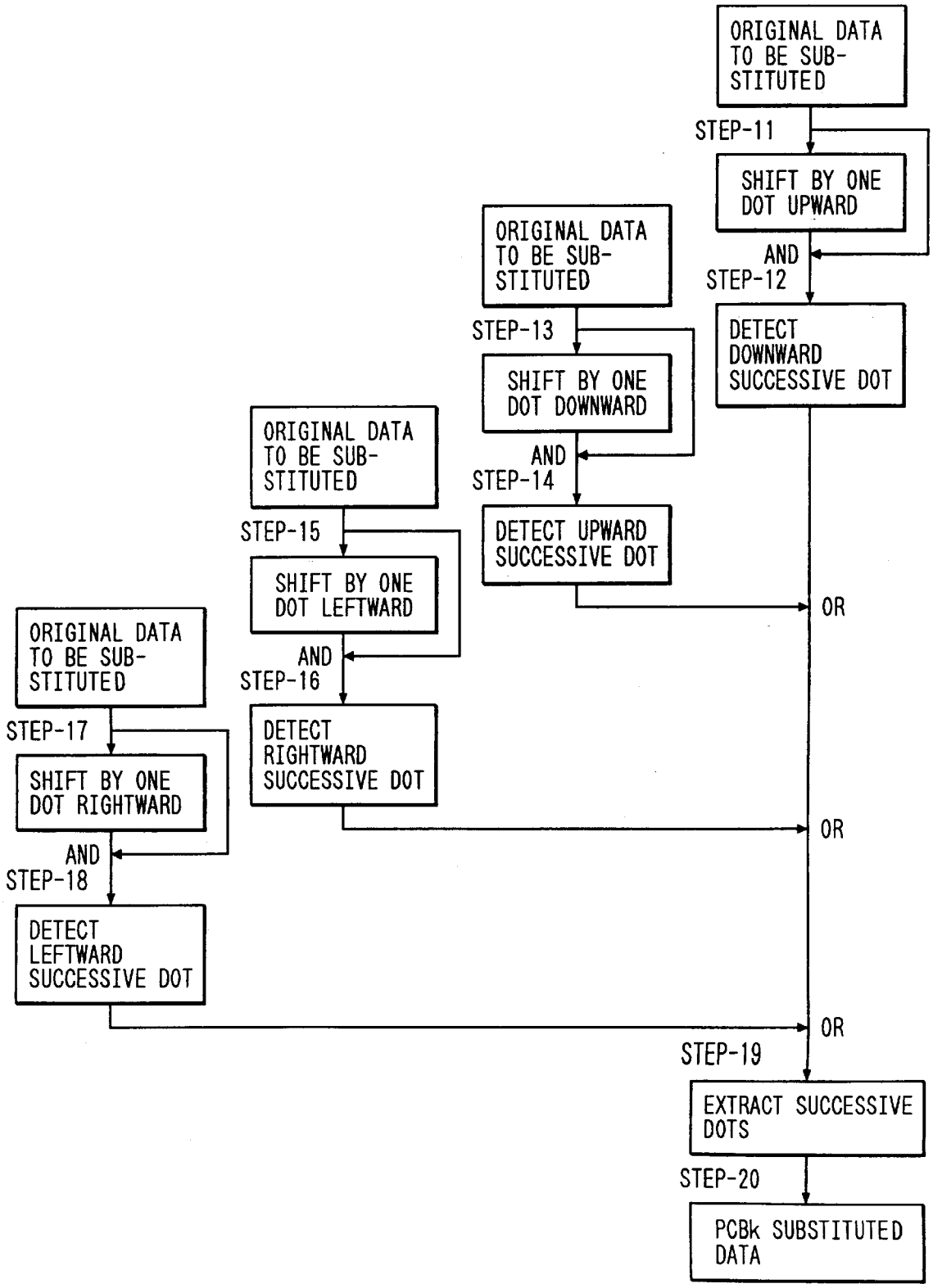
FIG. 19 shows a continuous dots detection sequence for implementing an Embodiment 7.

In the present embodiment, the print data to be substituted (or displaced) to the PCBk is detected in the boundary detection sequence shown in FIG. 15. Namely, Steps 1 to 4 of FIG. 15 are conducted to extract the Bk data to be substituted to the PCBk. A sequence of FIG. 19 is conducted to the Bk data. In FIG. 19, the Bk data to be substituted to the PCBk is represented as the substitution original data.

In Step 11, the substitution original data is shifted by one dot upward. The shifted data and the substitution original data are ANDed. In Step 12, continuous dots below the dot in consideration are detected and they are temporarily stored in the ROM.

Similarly, in Steps 13 and 14, upward continuous dots are detected, in Steps 15 and 16, rightward continuous data are detected, and in Steps 17 and 18, leftward continuous dots are detected.

In Step 19, all detected continuous dots are ORed and in Step 10 the extracted continuous dots are stored as the PCBk substitution data.

Figure 20:
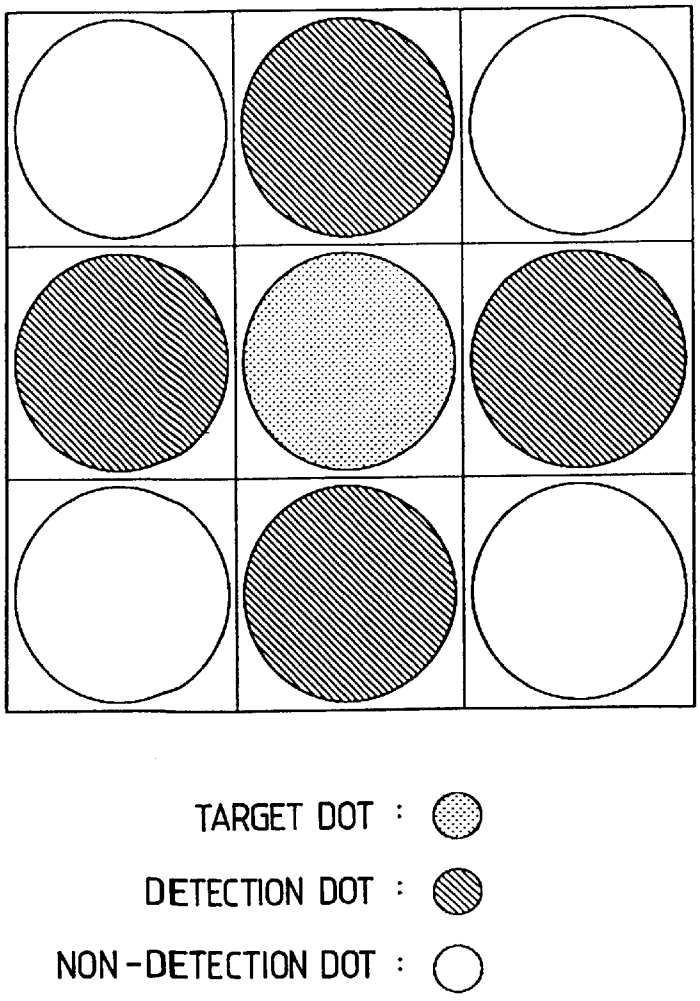
FIG. 20 illustrates continuous dots detected in the Embodiment 7.

In the present sequence, as sbown in FIG. 20, the one or more continuous dots upward, downward, leftward and rightward of the dot in consideration are detected. The diagonal dots are not detected. Accordingly, in the present sequence, only those dots which are continuous in the direction of the nozzle line of the recording head or the direction of scan of the carriage are detected and used as the PCBk substitution data. By conducting the present sequence, the one-dot discrete point is eliminated from the PCBk substitution. The zig-zag or inverted zig-zag pattern is also eliminated from the PCBk substitution. In other words, the Bayer type data is eliminated from the PCBk substitution for the 50% or less duty, and for the data of more than 50% duty, the number of dots for the PCBk substitution increases as the duty factor increases.

The low duty data which has a high possibility of synchronization with the PCBk substitution mask may be eliminated from the PCBk substitution and the high duty data which is apt to generate the blur at the boundary may be PCBk substituted.

By detecting the upward, downward, leftward and rightward continuous dot for the data to be PCBk substituted and conducting the PCBk substitution to only the continuous dots, the change in the tonality due to the PCBk substitution can be prevented. Even when the PCBk substitution is conducted, the data is of high duty and the substituted print data is hard to be biased, and the change in the tonality is relatively not prominent. The preset sequence provides the proper PCBk substitution.

[Embodiment 8]

Figure 23:
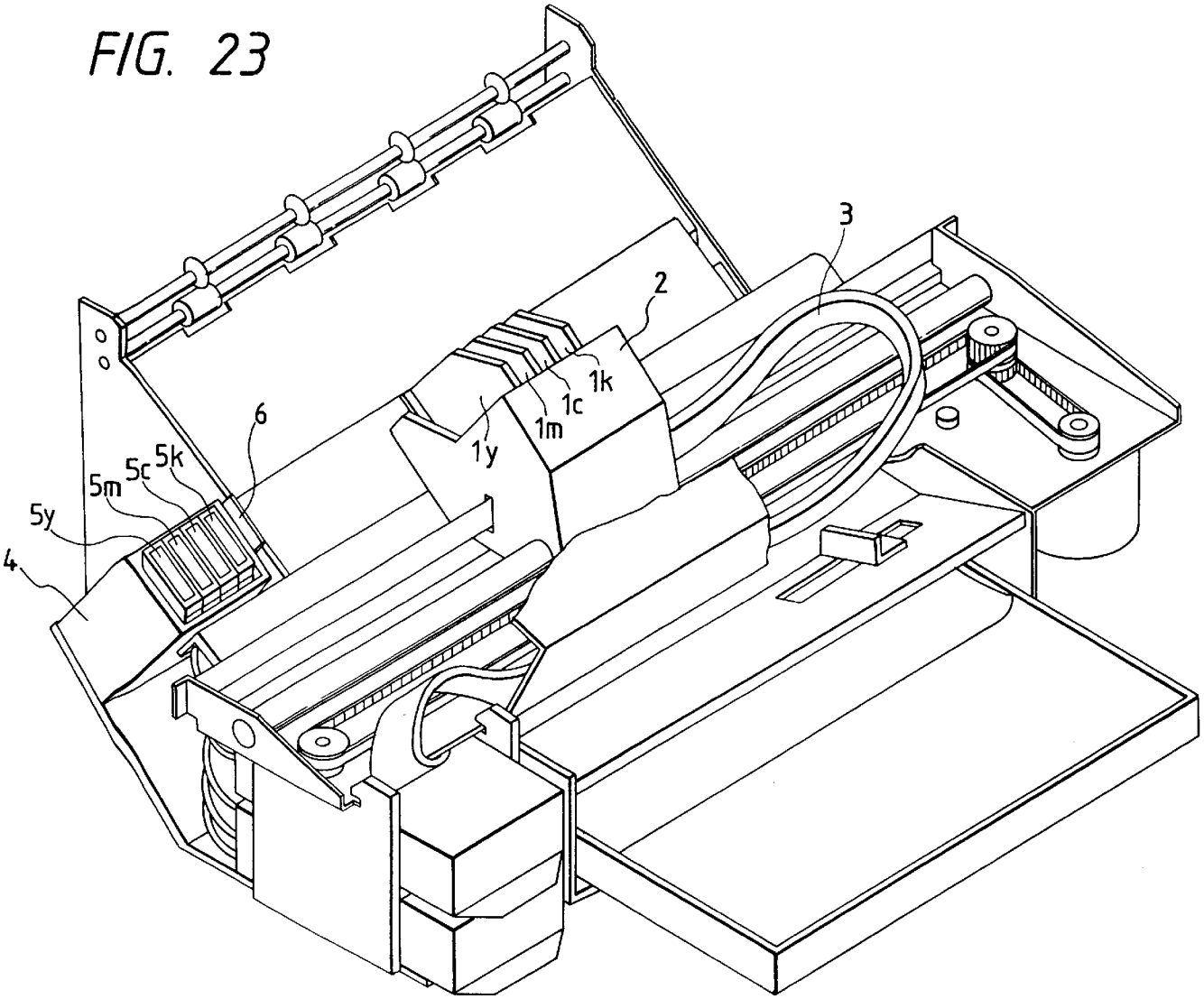
FIG. 23 shows a perspective view of other ink jet recording apparatus used in an Embodiment 8 to which the present invention is applied.

FIG. 23 shows another color ink jet printer to which the present invention is applied. Numeral 1*y* denotes a yellow ink recording head, numeral 1*m* denotes a magenta ink recording head, numeral 1*c* denotes a cyan ink recording head, numeral 1*b* denotes a first black ink recording head, numeral 1*k* denotes a second black ink recording head, numeral 2 denotes a carriage carrying the recording heads, numeral 3 denotes a flexible cable through which electrical signals are sent from the printer main body to the recording head, numeral 4 denotes a cap unit having recovery means, numerals 5*y*, 5*m*, 5*c* and 5*k* denote cap members for the recording heads 1*y*, 1*m*, 1*c* and 1*k*, respectively, and numeral 6 denotes a wiper blade made of rubber.

The construction of the nozzles of the recording heads 1*y*, 1*m*, 1*c* and 1*k* are basically identical to those of the recording head 102 shown in the above embodiment and each head has 128 discharge ports. Each nozzle of the recording heads 1*y*, 1*m* and 1*c* discharges approximately 40 ng of ink while each nozzle of the recording head 1*k* discharges approximately 80 ng of ink. The fast penetration velocity ink to the record sheet is used for the recording heads 1*y*, 1*m* and 1*c* and the low penetration velocity ink to the record sheet is used for the recording head 1*k*.

The present invention is also implemented by the above printer. The feature of the present embodiment resides in that the recording time is shorter because the recording heads of the same size are arranged in parallel.

In the Embodiments 5 to 8, when the PCBk substitution is made at the boundary of the color image area and the black image area, the change in the tonality due to the substitution is made less prominent. Further, by imparting a limitation to the data to be PCBk substituted, the change in the tonality can be prevented. Thus, the high record quality with less feathering in the black image area is attained and the high record quality with less ink blur at the boundary of the black image area and the color image area is attained. Thus, the compatibility of the high quality black record and the high quality color record is attained.

In the above embodiments, the control and processing means for the image discrimination, determination, image development and substitution processes are centrally handled in the control unit in the recording apparatus although the present invention is not limited thereto.

For example, the control and process means may be implemented by an external apparatus such as a printer driver to expand the system to receive the record data having the pixel substitution process completed. In many cases, the external apparatus connected to the recording apparatus is a host computer and the host computer is superior in the CPU processing capability for the above process and the RAM capacity.

The image determination process may be assigned to the host computer and the image development process may be assigned to the printer.

In the embodiments, the bubble jet recording method in which the bubbles are generated in the ink by the electro-thermal transducer and the ink are flown by the action of the bubbles although the present invention is also applicable to the so-called piezo ink jet recording system in which the ink is flown by an electro-mechanical transducer.

The present invention is particularly suitably usable in an ink jet recording head and a recording apparatus in which an electro-thermal transducer, a laser beam or the like is used to cause a change of state of the ink to eject or discharge the ink, because the high density of pixels and high resolution of recording are attained.

The typical construction and the operational principles are preferably the ones disclosed in U.S. Pat Nos. 4,723,129 and 4,740,796. The principle and the structure are applicable to a so-called on-demand type recording system and a continuous type recording system. Particularly, however, it is suitable for the on-demand type because the principle is such that at least one driving signal is applied to an electro-thermal transducer disposed on a liquid (ink) retaining sheet or liquid passage, the driving signal being large enough to provide such a quick temperature rise beyond a departure from nucleation boiling point, by which the thermal energy is provided by the electro-thermal transducer to produce film boiling on the heating portion of the recording head, whereby a bubble can be formed in the liquid (ink) corresponding to each of the driving signals. By the generation, development and contraction of the bubbles, the liquid (ink) is ejected through an ejection outlet to produce at least one droplet. The driving signal is preferably in the form of a pulse because the development and the contraction of the bubbles can be effected instantaneously, and therefore the liquid (ink) is ejected with fast response. The driving signal is preferably such as those disclosed in U.S. Pat. Nos. 4,463,359 and 4,345,262. In addition, the temperature rise rate of the heating surface is preferably such as those disclosed in U.S. Pat. No. 4,313,124.

The structure of the recording head may be those shown in U.S. Pat. Nos. 4,558,333 and 4,459,600 in which the heating portion is disposed at a bent portion, as well as the structure of the combination of the ejection outlet, liquid passage and the electro-thermal transducer disclosed in the above-mentioned patents. In addition, the present invention is applicable to the structure disclosed in Japanese Laid-Open Patent Application No. 59-123670 in which a common slit is used as the ejection outlet for a plurality of electro-thermal transducers, and the structure disclosed in Japanese Laid-Open Patent Application No. 59-138461 in which an opening for absorbing a pressure wave of thermal energy is formed corresponding to the ejection outlet. This is because the present invention is effective to preform the recording with certainty and high efficiency irrespective of the type of the recording head.

In addition, the present invention is applicable to a serial type recording head in which the recording head is fixed on a main assembly, to a replaceable chip type recording head which is connected electrically with the apparatus and can be supplied with the ink when it is mounted in the main assembly, or to a cartridge type recording head having an integral ink container.

The provisions of the recovery means and/or the auxiliary means for the preliminary operation are preferable because they further stabilize the effects of the present invention. As for such means, there are capping means for the recording head, cleaning means therefor, pressing or sucking means, preliminary heating means which may be an electro-thermal transducer, an additional heating element or a combination thereof. Also, means for effecting preliminary ejection (not for the recording) may stabilize the recording operation.

As regards the variation of the recording head mountable, it may be a single head for a single color or plural heads for a plurality of inks having different colors or densities. The present invention is effectively applicable to an apparatus having at least one of a monochromatic mode mainly with black, a multi-color mode with different color inks and/or full color mode using the mixture of colors, which may be an integrally formed recording unit or a combination of a plurality of recording heads.

Furthermore, in the foregoing embodiment, the ink is liquid. Alternatively, ink which is solidified below a room temperature and liquefied at a room temperature may be used. Since the ink is controlled within a temperature range of not lower than 30° C. and not higher than 70° C. to stabilize the viscosity of the ink to provide the stable ejection in a conventional recording apparatus of this type, the ink may be such that it is liquid within the temperature range when the recording signal is applied. The present invention is applicable to other type of ink. In one of them, the temperature rise due to the thermal energy is positively prevented by consuming it for the state change of the ink from the solid state to the liquid state. Another ink is solidified when it is left, to prevent the evaporation of the ink. In any case, the application of the recording signal produces thermal energy, the ink is liquefied, and the liquefied ink may be ejected. Another ink may start to be solidified at the time when it reaches the recording sheet.

The present invention is also applicable to the ink which is liquefied by the application of the thermal energy. Such ink may be retained in liquid state or solid state in holes or recesses formed in a porous sheet as disclosed in Japanese Laid-Open Patent Application No. 54-56847 and Japanese Laid-Open Patent Application No. 60-71260. The sheet is faced to the electro-thermal transducers. The most effective one of the inks described above is the film boiling system.

The ink jet recording apparatus may be used as an output terminal of an information processing apparatus such as a computer or the like, as a copying machine combined with an image reader or the like, or as a facsimile machine having information sending and receiving functions.

While the invention has been described with reference to the structures disclosed herein, it is not confined to the details set forth and the present invention is intended to cover such modifications or changes as may come within the objects of the improvements or the scope of the claims.

What is claimed is:

1. A color ink jet recording method for recording by using yellow ink, magenta ink, cyan ink and first black ink having a relatively fast penetration velocity to a recording medium and second black ink having a relatively slow penetration velocity to the recording medium, comprising the steps of:

discriminating between a black text and an image area on the basis of input image data;

determining whether the black text is adjacent to the image area;

deciding whether the black text is to be formed by the first black ink or the second black ink in accordance with the determination in said determining step;

forming an image in accordance with the decision in said deciding step;

wherein said deciding step decides to form the black text adjacent to the image area using the first black ink and decides to form the black text not adjacent to the image area using only the second black ink; and said forming step forms an image within the image area using the first black ink.

2. A color ink jet recording process according to claim 1, wherein said decision step decides to form the black image by using the first black ink and at least one of the yellow, magenta and cyan inks in a predetermined proportion when the black image is adjacent to the color image.

3. A color ink jet recording method according to claim 1, wherein each of said inks is discharged by thermal energy.

4. A color ink jet recording method according to claim 1, wherein said decision step decides to form the black image by using the first black ink and the second black ink in a predetermined proportion when the black image is adjacent to the color image.

5. A method according to claim 1, further comprising the steps of:

storing image data corresponding to the black text in a first black image memory for storing image data corresponding to the first black ink or in a second black image memory for storing image data corresponding to the second black ink, in accordance with the decision in said deciding step; and storing image data corresponding to the image area in memories corresponding to respective colors and in said second black image memory, wherein said forming step forms an image in accordance with image data stored in the memories corresponding to the respective colors, said first black image memory and said second black image memory.

6. A color ink jet recording apparatus for recording by using yellow ink, magenta ink, cyan ink and first black ink having a relatively fast penetration velocity to a recording medium and second black ink having a relatively slow penetration velocity to the recording medium, comprising:

discrimination means for discriminating between a black text and an image area in accordance with input image data;

determination means for determining whether the black text is adjacent to the image area;

decision means for deciding whether the black text is to be formed by the first black ink or the second black ink in accordance with the determination of said determination means; and record control means for forming an image in accordance with the decision of said decision means, wherein said decision means decides to form the black text adjacent to the image area using the first black ink and decides to form the black text not adjacent to the image area using only the second black ink; and said record control means forms an image within the image area using the first black ink.

7. A color ink jet recording apparatus according to claim 6, wherein said decision means decides to form the black image by using the first black ink and at least one of the yellow, magenta and cyan inks in a predetermined proportion when the black image is adjacent to the color image.

8. A color ink jet recording apparatus according to claim 6, wherein the yellow ink, the magenta ink, the cyan ink, the first black ink and the second black ink are discharged from recording heads.

9. A color ink jet recording apparatus according to claim 8, further comprising a carriage for carrying said recording heads.

10. A color ink jet recording apparatus according to claim 8, further comprising transport means for transporting the recording medium recorded by said recording heads.

11. A color ink jet recording apparatus according to claim 6, wherein the yellow ink, the magenta ink, the cyan ink and the first black ink are discharged from a first recording head and the second black ink is discharged from a second recording head.

12. A color ink jet recording apparatus according to claim 6, wherein said apparatus is applied to a copying machine.

13. A color ink jet recording apparatus according to claim 6, wherein said apparatus is applied to a facsimile machine.

14. A color ink jet recording apparatus according to claim 6, wherein said apparatus is applied to a computer terminal.

15. A color ink jet recording apparatus according to claim 6, wherein each of the inks is discharged by thermal energy.

16. A color ink jet recording apparatus according to claim 6, wherein said decision means decides to form the black image by using the first black ink and the second black ink in a predetermined proportion when the black image is adjacent to the color image.

17. An apparatus according to claim 6, further comprising:

a plurality of memories for storing image data for respective inks, said memories including a first black memory for storing image data corresponding to the first black ink, a second black memory for storing image data corresponding to the second black ink, and color image memories for storing image data corresponding to respective colors; and memory control means for storing image data corresponding to the black text in the first black memory or the second black memory in accordance with the decision by said decision means, and for storing image data corresponding to the image area in the color image memories and the first black memory.

18. A color ink jet recording method for recording a color image on a recording medium in accordance with record data by using black ink and a plurality of color inks having a different penetration velocity to the recording medium than that of the black ink, comprising the steps of:

determining whether a color image area having a color image is present in a vicinity of a black image area having a black image of the record data;

deciding, in accordance with the determination in said determining step, to form the black image from the black ink when the color image area is not present in the vicinity of the black image area, and to form the black image from the plurality of color inks and the black ink when the color image area is present in the vicinity of the black image area; and when the black image area is to be formed by the color inks, deciding areas to be formed by the color inks and the black ink, respectively, using a corresponding mask pattern for each color ink and black ink, and forming the black image adjacent to the color image area using the color inks and the black ink.

19. A color ink jet recording method according to claim 18, wherein each of said inks is discharged by thermal energy.

20. A color ink jet recording method according to claim 18, wherein said mask pattern is a mask pattern prepared pseudo-randomly.

21. A color ink jet recording method for recording a color image on a recording medium in accordance with record data by using black ink and a plurality of color inks having a different penetration velocity to the recording medium from that of the black ink, comprising the steps of:

determining whether a color image area having a color image is present in a vicinity of a black image area having a black image of the record data;

deciding, in accordance with the determination in said determining step, to form the black image from the black ink when the color image area is not present in the vicinity of the black image area, and to form the black image from the plurality of color inks and the black ink when the color image area is present in the vicinity of the black image area; and when the black image area is to be formed by the color inks and the black ink, forming the black image by using a corresponding mask pattern for each of the color inks and the black ink including an alternating arrangement of a basic pattern of dots and an inverted pattern of the basic pattern of dots.

22. A color ink jet recording method according to claim 21, wherein each of said inks is discharged by thermal energy.

23. A color ink jet recording method for recording a color image on a recording medium in accordance with record data by using black ink and a plurality of color inks having a different penetration velocity to the recording medium from that of the black ink, comprising the steps of:

determining whether a color image area having a color image is present in a vicinity of a black image area having a black image of the record data;

deciding, in accordance with the determination in said determining step, to form the black image from the black ink when the color image area is not present in the vicinity of the black image area, and to form the black image from the plurality of color inks and the black ink when the color image area is present in the vicinity of the black image area;

producing image data corresponding to the plurality of colors using a corresponding mask pattern for each of the color inks and the black ink when the corresponding black image is formed in accordance with the decision; and forming the black image in accordance with the decision.

24. A color ink jet recording method according to claim 23, wherein each of said inks is discharged by thermal energy.

25. A color ink jet recording apparatus for recording a color image on a recording medium in accordance with record data by using black ink and a plurality of color inks having a different penetration velocity to the recording medium from that of the black ink, comprising:

detection means for detecting whether a color image area having a color image is present in a vicinity of a black image area having a black image of the record data; and conversion means for converting the record data in the black image area such that the black image area is recorded using the plurality of color inks and the black ink based on a pseudo-random mask pattern when said detection means detects that the color image area is present in the vicinity of the black image area.

26. A color ink jet recording apparatus according to claim 25, wherein the black ink and the color inks are discharged from recording heads.

27. A color ink jet recording apparatus according to claim 26, further comprising a carriage for carrying said recording heads.

28. A color ink jet recording apparatus according to claim 26, further comprising transport means for transporting the recording medium recorded by said recording heads.

29. A color ink jet recording apparatus according to claim 25, wherein said apparatus is applied to a copying machine.

30. A color ink jet recording apparatus according to claim 25, wherein said apparatus is applied to a facsimile machine.

31. A color ink jet recording apparatus according to claim 25, wherein said apparatus is applied to a computer terminal.

32. A color ink jet recording apparatus according to claim 25, wherein each of the inks is discharged by thermal energy.

33. A color ink jet recording apparatus for recording a color image on a recording medium in accordance with record data by using black ink and a plurality of color inks having a different penetration velocity to the recording medium from that of the black ink, comprising:

detection means for detecting whether a color image area having a color image is present in a vicinity of a black image area having a black image of the record data; and conversion means for converting the record data in the black image area such that the black image area is recorded using the plurality of color inks and the black ink based on a mask pattern having an alternating arrangement of a basic pattern of dots and an inverted pattern of the basic pattern of dots, when said detection means detects that the color image area is present in the vicinity of the black image area.

34. A color ink jet recording apparatus according to claim 33, wherein the black ink and the color inks are discharged from recording heads.

35. A color ink jet recording apparatus according to claim 34, further comprising a carriage for carrying said recording heads.

36. A color ink jet recording apparatus according to claim 34, further comprising transport means for transporting the recording medium recorded by said recording heads.

37. A color ink jet recording apparatus according to claim 33, wherein said apparatus is applied to a copying machine.

38. A color ink jet recording apparatus according to claim 33, wherein said apparatus is applied to a facsimile machine.

39. A color ink jet recording apparatus according to claim 33, wherein said apparatus is applied to a computer terminal.

40. A color ink jet recording apparatus according to claim 33, wherein each of the inks is discharged by thermal energy.

41. A color ink jet recording apparatus for recording a color image on a recording medium in accordance with record data by using black ink and a plurality of color inks having a different penetration velocity to the recording medium from that of the black ink, comprising:

detection means for detecting whether a color image area having a color image is present in a vicinity of a black image area having a black image of the record data; and conversion means for converting the record data in the black image area to be recorded by the plurality of color inks and the black ink, when said detection means detects that the color image area is present in the vicinity of the black image area.

42. A color ink jet recording apparatus according to claim 41, wherein the black ink and the color inks are discharged from recording heads.

43. A color ink jet recording apparatus according to claim 42, further comprising a carriage for carrying said recording heads.

44. A color ink jet recording apparatus according to claim 42, further comprising transport means for transporting the recording medium recorded by said recording heads.

45. A color ink jet recording apparatus according to claim 41, wherein said apparatus is applied to a copying machine.

46. A color ink jet recording apparatus according to claim 41, wherein said apparatus is applied to a facsimile machine.

47. A color ink jet recording apparatus according to claim 41, wherein said apparatus is applied to a computer terminal.

48. A color ink jet recording apparatus according to claim 41, wherein each of the inks is discharged by thermal energy.

* * * * *

UNITED STATES PATENT AND TRADEMARK OFFICE

CERTIFICATE OF CORRECTION

PATENT NO. : 6,116,720
DATED : September 12, 2000
INVENTOR(S) : Toshiharu Inui et al.

It is certified that error appears in the above-identified patent and that said Letters Patent is hereby corrected as shown below:

Column 2,
Line 28, "the step" should read -- the determining step --; and
Lines 39, 50, and 60, "one" should read -- the --.

Column 3,
Line 9, "one" should read -- the --.

Column 4,
Line 49, "embodiment" should read -- embodiments --.

Column 6,
Line 53, "pipe" should read -- pipes --.

Column 7,
Line 44, "control" should read -- controls --.

Column 10,
Line 58, "reduce" should read -- reduced --.

Column 11,
Line 55, "provide" should read -- provided --.

Column 12,
Lines 52 and 53, "BK" should read -- Bk --.

Column 15,
Line 1, "sbown" should read -- shown --.

Signed and Sealed this

Eighteenth Day of December, 2001

*Attest:*

*Attesting Officer*

JAMES E. ROGAN
*Director of the United States Patent and Trademark Office*